US006670089B2

(12) United States Patent
Ehara et al.

(10) Patent No.: US 6,670,089 B2
(45) Date of Patent: Dec. 30, 2003

(54) ELECTROPHOTOGRAPHIC IMAGE FORMING METHOD AND APPARATUS

(75) Inventors: Toshiyuki Ehara, Yokohama (JP); Tatsuyuki Aoike, Mishima (JP); Junichiro Hashizume, Numazu (JP); Masaharu Miura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 10/042,370

(22) Filed: Jan. 11, 2002

(65) Prior Publication Data

US 2002/0150831 A1 Oct. 17, 2002

(30) Foreign Application Priority Data

Jan. 11, 2001 (JP) ..... 2001-003900

(51) Int. Cl.[7] ..... G03G 13/09

(52) U.S. Cl. ..... 430/126; 430/66; 430/122; 399/159

(58) Field of Search ..... 430/126, 110.3, 430/66, 122; 399/159

(56) References Cited

U.S. PATENT DOCUMENTS 5,853,936 A * 12/1998 Segi et al. ..... 430/69
5,939,230 A * 8/1999 Kojima et al. ..... 430/56
5,970,285 A 10/1999 Ito et al. ..... 399/149
6,128,456 A 10/2000 Chigono et al. ..... 399/176
6,240,269 B1 * 5/2001 Kaya et al. ..... 399/128
6,272,301 B1 8/2001 Kawada et al. ..... 399/148

FOREIGN PATENT DOCUMENTS

| | | |
|---|---|---|
| JP | 9-325578 | 12/1997 |
| JP | 10-213946 | 8/1998 |
| JP | 2811312 | 10/1998 |
| JP | 10-307455 | 11/1998 |
| JP | 2000-98846 | 4/2000 |

* cited by examiner

*Primary Examiner*—John Goodrow
(74) *Attorney, Agent, or Firm*—Fitzpatrick, Cella, Harper & Scinto

(57) ABSTRACT

An electrophotographic image forming method having cyclic steps including a charging step of charging a rotating image-bearing member to charge a surface thereof, a latent image forming steps of forming an electrostatic latent image on the charged surface of the image-bearing member, a developing step of developing the electrostatic latent image with a magnetic toner to form a toner image thereon, and a transfer step of transferring the toner image onto a recording material. In the method, the image-bearing member includes an electroconductive support, and a photoconductor layer and a surface layer formed on the support.

30 Claims, 4 Drawing Sheets

ELECTROPHOTOGRAPHIC IMAGE FORMING METHOD AND APPARATUS

FIELD OF THE INVENTION AND RELATED ART

The present invention relates to an electrophotographic image forming system (method and apparatus) including a specific system) using non-single crystal silicon-based electrophotographic photosensitive member, a contact charging means and a spherical toner and including no cleaning step between the transfer and charging system, and more particularly to such an electrophotographic image forming system using a non-single crystalline silicon photosensitive member provided with a surface layer having a silicon content (percentage of silicon versus total of silicon and carbon).

A conventional electrophotographic image forming method generally includes a cycle of charging-exposure-development-transfer-cleaning of transfer residual toner-residual charge removal of the photosensitive member-charging (in a subsequent cycle). According to this, transfer residual toner remaining on the photosensitive member (image-bearing member) after the transfer step is removed from the photosensitive member surface and recovered as waste toner by a cleaner (cleaning device). It is desired that such waste toner does not occur from a viewpoint of environmental protection. Accordingly, there has been proposed an electrophotographic apparatus of a toner-recycle type having removed such a cleaner and including a developing device for simultaneous developing and cleaning for removing transfer residual toner on the photosensitive member and recover it in the developing device for reuse. Such an electrophotographic apparatus is disclosed in, e.g., Japanese Laid-Open Patent Application (JP-A) 10-307455.

Simultaneous developing and cleaning is an operation of removing the transfer residual toner on the photosensitive member in a developing step of a subsequent cycle, i.e., after charging and exposing the photosensitive member to form a latent image, under the action of a fog-removing bias voltage difference Vback (i.e., a potential difference between a DC voltage applied to the developing device and the surface potential on the photosensitive member). According to this method, the transfer residual toner is recovered in the developing device and re-used in a subsequent image forming cycle or later, thus removing the waste toner and reducing the troublesome maintenance operation. The cleanerless system is advantageous for space economization, thus providing an electrophotographic apparatus remarkably reduced in size.

Hereinbelow, such a toner recycle process including a simultaneous developing and cleaning step will be briefly described with reference to FIG. 3.

(1) A photosensitive member 201 is supplied with a voltage by a contact charging member 202 to be uniformly charged to, e.g., a negative polarity in this case.

(2) The uniformly negatively charged photosensitive member 201 is exposed to light 203 carrying image data (e.g., laser light) for the reversal development scheme, to form a latent image thereon.

(3) A charged toner 205 comprising colored powder is supplied from a developing device 204 in a form corresponding to the latent image onto the photosensitive member 201 surface to form a visible toner image thereon. The toner in this case is a negatively charged one.

(4) By applying a voltage from a transfer roller 206 or by the action of a member exerting an electrostatic attraction force, the toner image is transferred onto a recording material (or transfer (-receiving) material) 207 to be fixed thereon by a fixing device 209. In this instance, a portion of the toner is caused to remain as a transfer residual toner without being transferred, and a portion of the residual toner is liable to be charged in a polarity opposite to the polarity to which the toner is normally charged by a voltage of an opposite polarity (e.g., positive) applied to the transfer roller 206. The portion of the transfer residual toner charged to the opposite polarity may be referred to as an inverted toner 208.

(5) The transfer residual toner remaining on the photosensitive member surface including the above-mentioned inverted toner 208 is re-charged to the normal toner charge polarity by rubbing between the contact charging member 202 and the photosensitive member 202 in the step (1) of a subsequent cycle and then discharged onto the photosensitive member. The charging of the invented toner to the normal polarity may be referred to a normalization of toner polarity.

(6) The residual toner re-charged to the normal polarity is recovered to the developing device 204 together with excessive toner supplied at the time of development under the action of a developing bias voltage.

By repeating the above-mentioned cycle, a system yielding no waste toner is realized. The above explanation is a summary and not an exhaustive description of such a cleanerless system.

Incidentally, JP-A 10-307455 discloses a toner recycle process using a non-single crystalline silicon photosensitive member. Further, JP-A 2000-98846 contains a disclosure regarding contact charging of a non-single crystal material having a surface layer comprising non-single crystalline carbon.

Further, Japanese Patent (JP-B) 2811312, etc., discloses a composition represented by a formula of $Si_{1-x}C_x$ with a value x of $0.5<x<0.9$, and JP-A 10-20663 discloses a composition represented by a formula of $Si_{1-x}C_x$ with a value x of $0.95\leqq x<1$.

On the other hand, JP-A 10-213946 discloses a cleanerless process wherein a voltage lower than a saturation potential of a photosensitive member is applied to a charging means to improve the toner discharge. JP-A 10-2774884 contains a disclosure to the effect that it is desirable to normalize the toner charge in a toner recycle process. Further, JP-A 9-325578 discloses an auxiliary charging mean for charging the residual toner to an opposite polarity before the ordinary charging step.

A non-single crystalline silicon photo-sensitive member has a superior potential stability not comparable to any other photosensitive members and has been frequently used in high-speed copying machines and high-speed printers. Particularly, a photosensitive member comprising a photoconductor layer comprising a silicon-based non-single crystal material and a surface layer comprising a carbon-based non-single crystal material successively formed on an electroconductive support has excellent properties of sticking prevention, long life and environmental stability because of the characteristics of the non-single crystalline carbon film, such as lubricity, high hardness and oxidation resistance.

The potential stability is also desired in small-size machines and popular machines, but these machines are disposed after printing on at most one million sheets. This is not matched with a durability on several million sheets of a non-single crystalline silicon photosensitive member, thus posing an obstacle to wide popularization of the non-single crystalline silicone photosensitive member.

Further, when used in the above-mentioned cleanerless system, some among a variety of non-single crystal material silicon photosensitive members is liable to convert the inverted to a polarity distribution not readily recovered by the fog-prevention voltage, more specifically, to an average polarity opposite to the normal charge polarity, thus posing a difficulty for realizing a cleanerless system capable of fully enjoying the advantages of a non-single crystalline silicon photosensitive member.

Particularly, compared with a surface layer comprising an organic material such as a resin, a surface layer comprising a carbon-based non-single crystal material is liable to make difficult the normalization of inverted toner, thus causing image defects, such as image fog and lower image density due to deterioration of the developer.

It is particularly important that the toner and the photosensitive member have an identical charge polarity so as to ensure an IAE (image area exposure) scheme wherein an image forming part or region on the photosensitive member is exposed to have a part of lower potential which is to be developed with the toner. The toner mixed in the charger is charged in the above-described manner and discharged in a normally charged polarity onto the photosensitive member by resolution against the charging member, followed by successful recovery under the developing bias voltage. On the other hand in a BAE (back area exposure) scheme wherein a region other than an exposed (i.e., charge-attenuated) part is developed with a toner charged to an opposite polarity, there are liable to be encountered difficulties that the toner fails to be discharged because of an insufficient charge or fails to be recovered even if it is discharged with a sufficient charge.

SUMMARY OF THE INVENTION

In view of the above-mentioned problems of the prior art, an object of the present invention is to provide an electrophotographic image forming system (method and apparatus) capable of well-operating a cleanerless toner recycle process while using a non-single crystalline silicon photosensitive member in a form well adapted to small-size machines and popular machines.

Another object of the present invention is to provide an electrophotographic image forming system capable of remarkably reducing the amount of waste material over an entire life of the system and stably providing clear images free from image flow or image irregularity for a long period in various environments.

Another object of the present invention is to provide an electrophotographic image forming system having a long life of charging member and capable of stably providing high-quality images with a minimum maintenance cost.

Another object of the present invention is to provide an electrophotographic image forming system wherein a non-single crystalline silicon photosensitive member is uniformly charged with no irregularity to provide clear images which are uniform, have a high contrast and a high resolution and are accompanied with little fog.

According to the present invention, there is provided an electrophotographic image forming method, comprising cyclic steps including:

a charging step of charging a rotating image-bearing member to charge a surface thereof, a latent image forming steps of forming an electrostatic latent image on the charged surface of the image-bearing member, a developing step of developing the electrostatic latent image with a magnetic toner to form a toner image thereon, and a transfer step of transferring the toner image onto a recording material, wherein the image-bearing member comprises an electroconductive support, and a photoconductor layer and a surface layer formed on the support; said photoconductor layer comprising a silicon-based non-single crystal material containing at least one of hydrogen and halogen, said surface layer comprising a carbon-based non-single crystal material containing at least one of hydrogen and halogen and also containing silicon in a proportion of 0.2 to 20 atm. % as calculated by Si/(Si+C), said magnetic toner comprises toner particles comprising at least a binder resin and a magnetic material, and inorganic fine powder, has an average circularity of at least 0.950 and has a saturation magnetization of 10 to 50 $Am^2/kg$ as measured at 79.6 kA/m, in the charging step, the image-bearing member is charged to a negative polarity by a contact charging means including charging particles comprising principally electroconductive particles having particle sizes of 0.1–10 $\mu$m, and a charging particle carrying member having an electroconductive and elastic surface and carrying the charging particles on the surface so as to contact the image-bearing member via the charging particles, in the latent image forming step, an image forming part of the surface of the image-bearing member is exposed to light to provide an attenuated potential thereat, thereby forming the electrostatic latent image, and no cleaning step is included between the transfer step and the charging step.

According to another aspect of the present invention, there is provided an electrophotographic image forming apparatus, comprising:

a rotating image-bearing member, a charging means for charging the rotating image-bearing member to charge a surface thereof, a latent image-forming means for forming an electrostatic latent image on the charged surface of the image-bearing member, a developing means for developing the electrostatic latent image with a magnetic toner to form a toner image thereon, and a transfer means for transferring the toner image onto a recording material, wherein the image-bearing member comprises an electroconductive support, and a photoconductor layer and a surface layer formed on the support; said photoconductor layer comprising a silicon-based non-single crystal material containing at least one of hydrogen and halogen, said surface layer comprising a carbon-based non-single crystal material containing at least one of hydrogen and halogen and also containing silicon in a proportion of 0.2 to 20 atm. % as calculated by Si/(Si+C), said magnetic toner comprises toner particles comprising at least a binder resin and a magnetic material, and inorganic fine powder, has an average circularity of at least 0.950 and has a saturation magnetization of 10 to 50 $Am^2/kg$ as measured at 79.6 kA/m, the charging means includes charging particles comprising principally electroconductive particles having particle sizes of 0.1–10 μm, and a charging particle-carrying member carrying the charging particles so as to contact the image-bearing member via the charging particles, thereby charging the image-bearing member to a negative polarity, the latent image-forming means includes an exposure means for exposing an image forming part of the image-bearing member to provide an attenuated potential thereat, and no cleaning means is present between the transfer means and the charging means along the surface of the image-bearing member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
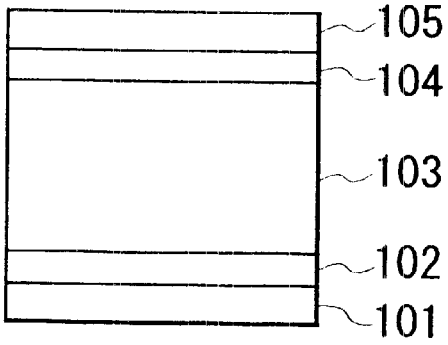
FIGS. 1 and 2 are schematic sectional views each showing an example of an electrophotographic photosensitive member used in an electrophotographic image forming apparatus according to the invention.

With the above objects in mind, we have made an extensive study, particularly on the above-mentioned step (5) of normalizing the inverted toner. As a result, it has found that the step can be effected very smoothly and stably by using a non-single crystalline silicon photosensitive member (image-bearing member) provided with a surface layer comprising a carbon-based non-single crystal material containing at least silicon in a specific silicon content (percentage of silicon per total of the silicon and carbon).

More specifically, the image-bearing member (photosensitive member) used in the present invention comprises an electroconductive support, and a photoconductor layer and a surface layer formed on the support. The photoconductor layer comprises a silicon-based non-single crystal material containing at least one of hydrogen and halogen. The surface layer comprises a carbon-based non-single crystal material containing at least one of hydrogen and halogen and also contains silicon in a proportion of 0.2 to 20 atm. % as calculated by Si/(Si+C).

Herein, the "non-single crystal material" constituting a surface or photoconductor layer of the image-bearing member is principally in an amorphous state but can contain a minor proportion of microcrystalline or polycrystalline material unlike a single-crystal material as is understood from representative processes for production of such a photoconductor or surface layer described hereinafter. The term "silicon-based" or "carbon-based" means that the material comprises silicon or carbon as a principal element.

Based on an electrophotographic image forming system including the image-bearing member (non-single crystalline Si photosensitive member, hereinafter sometimes simply referred to as "a-Si (i.e., amorphous silicon) photosensitive member"), we have made a study for reducing waste materials discharged over a whole life of the system. As a result, we have arrived at a conclusion that it is effective to remove the cleaning step for re-utilization of transfer residual toner and recover the transfer residual toner in the developing step.

However, if a corona discharger is used in the charging step, a corona discharge irregularity is caused at the time of the transfer residual toner passing through the charger to result in a charge irregularity on the a-Si photosensitive member surface or abnormal discharge to damage the a-Si photosensitive member in a worst case.

Accordingly, contact charger noted for its ability of removing image flow or charging irregularity liable to be encountered in the case of a corona charger was tested. As a result, the occurrence of abnormal discharge could be prevented, but several difficulties were encountered due to soiling of the contact charger with the transfer residual toner, such as a lowering in performances of the charging member, a shorter life of the charging member, inferior image contrast and uniformity due to lowering in charging ability and a lowering in performances of transfer residual toner by attachment to the contact charger resulting in lower image qualities, such as increased fog.

As a result of further study, it has been found that the above difficulties can be alleviated by using a spherical magnetic toner comprising toner particles comprising at least a binder resin and a magnetic material, and inorganic fine powder, and an average circularity of at least 0.950, preferably at least 0.970. As a result of examination on soiling with transfer residual toner of the contact charging member, even if the charging member is once soiled with transfer residual toner, the transfer residual toner on the charging member is quickly discharged onto the a-Si photosensitive member to be recovered in the developing step, whereby the lowering in life of the charging member and charging performance can be prevented. This is believed to be accomplished as a combination of an a-Si photosensitive member having the above-mentioned specific surface layer and a spherical magnetic toner.

The mechanism of the improvement has not been fully clarified yet, but it is assumed that transfer residual toner present on the charging member is effectively discharged due to a specific attachment force between the a-Si photosensitive member and the magnetic toner, and judging from the fact that the combination of the specific surface layer and the spherical magnetic toner is effective, the attachment force (mainly assured to be an inter-molecular force) attributable to the surface free energy of the a-Si photosensitive member and the shape of the spherical magnetic toner has a great influence thereon. Further, the attachment force is believed to greatly depend on the silicon content in the surface layer and the average circularity of the spherical magnetic toner.

As mentioned above, the present invention has succeeded in realization of an electrophotographic image forming system providing high quality images, exhibiting a long life and yielding little waste materials by combining principally three factors of a contact charging device, a specific magnetic toner and an a-Si photosensitive member having a carbon-based surface layer having a specific silicon content (versus a total of the silicon and carbon).

Hereinbelow, the present invention will be described in more detail item by item.

As mentioned above, the image-bearing member (photosensitive member) used in the present invention comprises an electroconductive support, and a photoconductor layer and a surface layer formed on the support. The photoconductor layer comprises a silicon-based non-single crystal material containing at least one of hydrogen and halogen. The surface layer comprises a carbon-based non-single crystal material containing at least one of hydrogen and halogen and also contains silicon in a proportion of 0.2 to 20 atm. % as calculated by Si/(Si+C).

Figure 2:
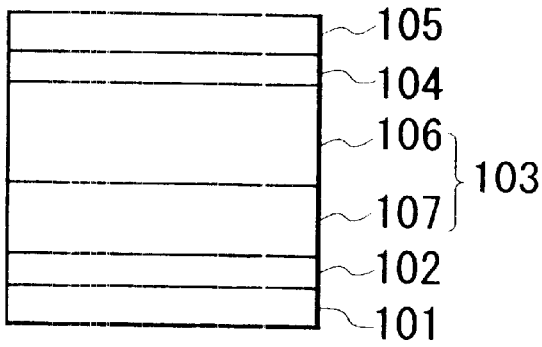

FIGS. 1 and 2 are schematic sectional views each showing a laminate structure of an electrophotographic photosensitive member used in the present invention.

More specifically, an a-Si photosensitive member shown in FIG. 1 includes an electroconductive support 101 of, e.g., aluminum, and a charge injection barrier layer (lower barrier layer) 102, a photoconductor layer 103 and a surface layer 105. The charge injection barrier layer 102 may be disposed as desired for preventing charge injection from the electroconductive support 101 to the photoconductor layer 103. The photoconductor layer 103 comprises an Si-based non-single crystal material and exhibits photoconductivity. As shown in FIG. 1, it is possible to optionally include a buffer layer 104 between the photoconductor layer 103 and the surface layer 105 as a layer for preventing charge injection from the surface to the photoconductor layer 103 and/or for protecting the surface.

As shown in FIG. 2, the photoconductor layer 103 may be functionally separated into a charge transport layer 107 of a non-single crystal material comprising at least silicon and carbon and a charge generation layer 106 of a non-single crystal material comprising at least silicon, successively laminated.

The organization of the respective layers will be described.

Electroconductive Support

The electroconductive support 101 may comprise an electro-conductive or -nonconductive substrate. The electroconductive support may be composed of an electroconductive substrate comprising: a metal, such as Al, Cr, Mo, Au, In, Nb, Ge, V, Ti, Pt, Pd or Fe, or an alloy of these metals, such as stainless steel. Alternatively, the electroconductive support may also be formed by coating at least a side of forming a photosensitive layer of an insulating substrate, such as a film or sheet of synthetic resins, such as polyester, polyethylene, polycarbonate, cellulose acetate, polypropylene, polyvinyl chloride, polystyrene or polyamide, or glass or ceramic sheet, with an electroconductive layer.

Photoconductor Layer

The photoconductor layer 103 may be formed by various vacuum film deposition processes, inclusive of glow discharge processes (AC-discharge CVD, such as low-frequency CVD, high-frequency CVD, and microwave CVD, or DC-discharge CVD), sputtering, vacuum evaporation, ion plating, photo-CVD, and thermo-CVD. These vacuum film deposition processes and conditions thereof may be appropriately selected, in view of investment costs, production scale and desired properties of the resultant photosensitive members, but it is generally suitable to use a glow discharge process, particularly a high-frequency glow discharge process using a power source frequency of RF-band, $\mu$W-band or VHF-band.

As is well known, the formation of a photoconductor layer 103 by the glow discharge process may basically be performed by introducing an Si-supply source gas for supplying silicon (Si) atoms, an H-supply source gas for supplying hydrogen (H) atoms and/or an X-supply source gas for supplying halogen (X) atoms into a reaction vessel placeable in a reduced pressure to cause glow discharge therein, thereby forming a layer of a-Si:H,X on an electroconductive support 101 disposed in advance at a prescribed position in the vessel.

In order to compensate for dangling bonds of silicon atoms to provide the layer with improved performances, particularly photoconductivity and charge retention characteristic, it is necessary to have the photoconductive layer 103 contain hydrogen atoms or/and halogen atoms in a proportion of preferably 10–30 atomic %, more preferably 15–25 atomic %, with respect to the total amount of silicon, and hydrogen or/and halogen.

Suitable examples of the halogen compounds usable in the present invention may include: fluorine gas ($F_2$), and inter-halogen compounds, such as BrF, ClF, $ClF_3$, $BrF_3$, $BrF_5$, $IF_3$ and $IF_7$. Suitable examples of the halogen-containing silicon compounds or so-called halogen-substituted silane derivative may include: silicon fluorides, such as $SiF_4$ and $Si_2F_6$.

The photoconductor 103 may preferably contain a conductivity-controlling atom, which can be contained uniformly in the photoconductor layer 103 or in different concentration in a thickness direction.

The conductivity-controlling atom may be a so-called impurity as used in the semiconductor field, and may be a group 13 atom in the periodic table for providing a p-type conductivity or a group 15 atom on the periodic table for providing an n-type conductivity.

The group 13 atoms may include: boron (B), aluminum (Al), gallium (Ga), indium (In) and tallium (Tl), and particularly suitably be B, Al and Ga. The group 15 atoms may include: phosphorus (P), arsenic (As), antimony (Sb) and bismuth, and particularly suitably be P and As.

The conductivity-controlling atom may be contained in the photoconductor layer 103 at a concentration appropriately selected in view of the chargeability and desired performances of the electrophotographic apparatus, but preferably $1\times10^{-2}$–$1\times10^{4}$ atom.ppm, more preferably $5\times10^{-2}$–$5\times10^{3}$ atom.ppm, particularly $1\times10^{-1}$–$1\times10^{3}$ atom.ppm.

For introducing the group 13 atom or group 15 atom into the photoconductor layer 103, a 13 atom-source compound or a 15 atom-source compound may be introduced in a gaseous state into the reaction vessel together with other source gases for providing the photoconductor layer 103. The 13 atom-source compound or the 15b atom-source compound may preferably be a gaseous compound under normal temperature and normal pressure, or at least a compound which can be readily gassifiable under the layer-forming condition.

It is also possible to dilute such a conductivity-controlling atom-introducing source material with H, He, etc., as desired.

It is also effective for the photoconductor layer 103 to contain carbon atom and/or oxygen atom and/or nitrogen atom. The content(s) of the carbon and/or oxygen and/or nitrogen may preferably be in a proportion of $1\times10^{-5}$–10 atm. %, more preferably $1\times10^{-4}$–8 atm. %, further preferably $1\times10^{-3}$–5 atm. %, based on the total of the silicon, carbon, oxygen and nitrogen. The carbon and/or oxygen and/or nitrogen can be contained at a uniform concentration throughout the photoconductor layer 103 or at different concentrations in a thickness direction of the photoconductor layer.

The photoconductor layer 103 may have a thickness determined appropriately depending on the desired electrophotographic performances and economical viewpoints, and preferably a thickness of 15–60 $\mu$m, more preferably 20–50

μm, further preferably 20–40 μm. Below 15 μm, a current passage of the charging member is liable to be excessively large to accelerate the deterioration. Above 60 μm, abnormally grown portions are liable to be formed in sizes of 50–150 μm in horizontal direction and 5–20 μm in height, so that non-ignorable damage to the charging member rubbing the surface can be occur in some cases.

The thickness of the photoconductor layer 103 may be adjusted by controlling the film-forming conditions, such source gas-introduction rate, while confirming the film thickness of the photoconductor layer 103 by a film thickness meter (e.g., "Fisher Scopemms", made by Helmut Fisher GmbH).

During the formation of the photoconductive layer 103, the electroconductive support 101 may be held at a temperature optionally selected according to the layer designing within a temperature range of preferably 200–350° C., more preferably 230–330° C., most suitably 250–310° C.

Surface Layer

The image-bearing member used in the present invention has a surface layer comprises a carbon-based non-single crystal material containing at least one of hydrogen and halogen and also containing silicon (which may also be represented by "a-SiC:H(X)". The silicon content in the surface layer is 0.2 to 20 atm. % as calculated by Si/(Si+C) (i.e., the percentage of silicon with respect to the total of the silicon and carbon in the surface layer).

If the silicon content in the surface layer is below 0.2 atm. %, the normalization toner charge discharged from the charging means is liable to be insufficient to result in fog. If the silicon content exceeds 20 atm. %, the discharge of the toner from the charging is liable to be obstructed, thus resulting in inferior charging performance, fog and increased surface wearing.

Generally, a-SiC:H(X) and a-C:H(X) (representing a carbon-based non-single crystal material containing at least one of hydrogen and halogen) has a high hardness and a high durability. The a-C:H(X) principally comprises amorphous carbon having an intermediate property between graphite and diamond but can partially contain micro-crystals or polycrystals. The surface layer 105 of a-SiC:H(X) can exhibit similar effects even if some impurities are contained therein. For example, even if impurities such a N,O, P and B are contained, the effect of the surface layer can be sufficiently retained if the impurity content is at most ca. 10 atm. %.

The surface layer may contain at least one of hydrgen and halogen, preferably contain hydrogen. By containing hydrogen, structural at least in the film are effectively compensated for to lower the localized level density, whereby the transparency of the layer is increased and undesirable light absorption at the surface layer is suppressed to improve the photosensitivity. Further, the presence of hydrogen in the surface layer is believed to play an important role in exhibiting solid lubricity.

The hydrogen content in the surface layer may suitably be 41 to 60 atm. % more suitably 45–50 atm. % as calculated by H/(Si+C+H). If the hydrogen content is below 41 atm. %, the optical band gap is narrowed to provide an unsuitable sensitivity. Above 60 atm. %, the hardness is liable to be lowered to result in abrasion. The optical band gap is suitably in a range of ca. 1.2–2.2 eV and more desirably 1.6 eV or higher in view of the sensitivity.

The surface layer provides a free surface and is disposed to exhibit the effect of preventing wear and scars in a long-term use as well as achieving the objects of the present invention of increasing the life and stabilizing the charging ability of the charging member.

The surface layer thickness may be measured by using a reflection spectral interference meter ("MCPD2000", made by Ohtsuka Denshi K.K.) to measure a degree of interference, and a surface layer thickness may be calculated from the measured degree of interference and a known refractive index. The surface layer thickness may be adjusted by the film forming condition, preferably in a range of 5–2000 nm, more preferably 10–100 nm. Below 5 nm, it becomes difficult to attain the effect in a long-term use. Above 2000 nm, difficulties, such a lowering in photosensitivity and residual potential, are liable to be encountered.

The substrate temperature during the film formation of the surface layer may be set within a range of room temperature to 400° C. A relatively low set temperature is preferred because an excessively high substrate temperature is liable to result in a lower band gap to result in a lower transmittance.

It is suitable that the surface layer has a refractive index of ca. 1.6–2.8, preferably 1.6–2.2, particularly preferably 1.6–2.0. The refractive index may be measured by multiple interference of long-wavelength light. More specifically, a surface layer is formed on a glass substrate (e.g., "7059", made by Corning Glass Works) is subjected to measurement of spectral transmittance for a short wavelength side ranging from around 2500 nm in a wavelength range giving 4–5 peak values by using a visible spectrometer (e.g., "330", made by Hitachi, Ltd.), and a refractive index is calculated from the wavelengths and transmittances at the resultant peak values. The relative permittivity of the surface layer 105 can be obtained by squaring the refractive index.

The values of silicon content (Si/(Si+C) described herein are based on values calculated from relative values of silicon and carbon contents measured by ESCA (by using. e.g., "SSX-100", made by SSI in USA).

The surface layer 105 may be formed through a known film deposition process, such as glow discharge, sputtering, vacuum evaporation, ion plating, photo-CVD (chemical vapor deposition) or thermal CVD. These film deposition processes may be appropriately selected, in view of production conditions, investment costs, production scale and desired properties of the resultant photosensitive members, but is is generally preferred to use a film deposition process identical to the one used for production of the photoconductor layer in view of the productivity of the image-bearing member.

More specifically, the surface layer may suitably formed through a known film deposition process wherein a feed gas comprising at least a hydrocarbon gas is decomposed by plasma to cause film deposition. Specific examples thereof may include a plasma CVD process at a high frequency of 50–450 MHz (VHF band) or a plasma CVD using an RF (radio frequency) power.

For decomposition of a feed gas comprising hydrocarbon, a larger high-frequency power is preferred for sufficient decomposition, preferably at least 5 W.min/ml for unit gas volume feed rate (ml/min) under normal conditions (NTP). However, an excessively large power is liable to cause abnormal discharge to result in inferior properties of the image-bearing member, so that the power should be suppressed within an extent of not causing abnormal discharge.

The pressure of the discharge space may be held on the order of 13.3 Pa–1333 Pa (0.1 Torr to 10 Torr) for an ordinary RF power (representatively at 13.56 MHz), and 13.3 mPa–13.3 Pa (0.1 mTorr to 100 mTorr) for a VHF-band power (representatively at 50–450 MHz).

The surface layer 105 may preferably contain a conductivity-controlling atom at a concentration which may be constant throughout the surface layer or vary in a thickness direction of the surface layer 105.

The conductivity-controlling atom may be a so-called impurity atom used in the semiconductor field, such as group 13 atom or group 15 atom for providing an n-type conductivity. The content of the conductivity-controlling atom in the surface layer may be appropriately determined as desired, preferably in a range of $10–1\times10^4$ atom.ppm, more preferably $50–5\times10^3$ atom.ppm, particularly $1\times10^2–1\times10^3$ atom.ppm.

Further, it is also possible dispose between the surface layer 105 and the photoconductive layer 103 a thickness region wherein the concentration of carbon is decreased toward the photoconductor layer 103. This is effective for improving the adhesion between the surface layer and the photoconductor layer and reducing any interference caused by light reflection at the boundary.

The surface layer can further contain halogen atoms as desired. Examples of the halogen-source compound may include: $F_2$ and inter-halogen compounds, such as BrF, ClF, $ClF_3$, $BrF_3$, $BrF_5$, $IF_3$ and $IF_7$. For the purpose of fluorine introduction, it is suitable to use a fluorine-containing gas, such as $CF_4$, $CHF_3$, $C_2F_6$, $ClF_3$, $CHClF_2$, $F_2$, $C_3F_8$ or $C_4F_{10}$.

In the case of forming a surface layer containing halogen, a larger high-frequency power is preferred for sufficient decomposition of the feed gas, preferably at least 5 W.min/ml for unit gas volume feed rate (ml/min) under normal conditions (NTP). However, an excessively large power is liable to cause abnormal discharge to result in inferior properties of the image-bearing member, so that the power should be suppressed within an extent of not causing abnormal discharge.

The pressure of the discharge space for providing a surface layer containing halogen may be held on the order of 13.3 Pa–1333 Pa (0.1 Torr to 10 Torr), particularly at most 133 Pa, for an ordinary RF power (representatively at 13.56 MHz), and 13.3 mPa–13.3 Pa (0.1 mTorr to 100 mTorr) for a VHF-band power (representatively at 50–450 MHz), and a lower pressure is preferred.

The halogen atom content in the surface layer may be appropriately determined as desired, preferably 6–50 atm. %, more preferably 30–50 atm. %, with respect to the total atoms.

Buffer Layer

It is also preferred embodiment of the image-bearing member of the present invention to dispose a buffer layer 104 between the surface layer 105 and the surface layer 103 as shown in FIGS. 1 and 2.

The buffer layer 104 may comprise a silicon-based non-single crystal material containing at least one of hydrogen and halogen (represented by a-Si:(H,X)) and further containing at least one species of atoms selected from carbon, nitrogen and oxygen. Such a non-single crystal material may comprise amorphous silicon carbide, amorphous silicon nitride or amorphous silicon carbide further containing at least one of hydrogen and halogen. It is further preferred to use a non-single crystal material principally comprising amorphous silicon carbide (a-Si:C(H,X)) having an intermediate composition between a-Si and a-C:H.

In this case, it is possible to change the composition of the buffer layer 104 continuously from the photoconductor layer 103 to the surface layer 105. The provision of such a buffer layer is effective for interference prevention, etc. It is also possible to incorporate a dopant of a group 13 element or a group 15 element in the buffer layer 104 to control the conductivity-type, thereby having the buffer layer 104 function as an upper barrier layer for preventing carrier injection from the surface.

Examples of feed gases for providing the bufer layer may suitably include the following.

Carbon-source gases may include gaseous or gassifiable hydrocarbons, such as $CH_4$, $C_2H_6$, $C_3H_8$ and $C_4H_{10}$, as suitable examples.

Nitrogen- or oxygen-source gases may include: gaseous or gassifiable compounds, such as $NH_3$, NO, $N_2O$, $NO_2$, $O_2$, CO, $CO_2$ and $N_2$.

The bufer layer may for example be formed by, e.g., plasma CVD, sputtering or ion plating. In the case of forming the bufer layer by plasma CVD, the discharge frequency may be selected at any levels including high frequencies of at least 1 MHz and below 50 MHz commercially called RF-band and high frequencies of at least 50 MHz and at most 450 MHz called VHF-band.

During the deposition of the buffer layer 4, the electroconductive support may preferably be held at 50–450° C., more preferably 100–300° C.

(Other Layers)

In addition to the above-mentioned surface layer 105, buffer layer 104 and photoconductor layer 103, it is also preferred to insert a lower barrier layer (charge injection barrier layer) 102 between the electroconductive substrate 101 and the photoconductor layer 103 as shown in FIGS. 1 and 2.

Such a lower barrier layer 102, when formed, may generally comprise a-Si(H,X) as a base material and further contains a dopant of a group 13 element or a group 15 element for controlling the conductivity type, so as to prevent carrier injection from the electroconductive substrate. In this case, it is also possible to incorporate at least one species of atoms selected from carbon, nitrogen and oxygen to adjust the stress, thereby increasing the adhesion of the photosensitive layers thereon.

Hereinbelow, an example of production procedure for producing a non-single crystal material silicon photosensitive member by using an apparatus shown in FIG. 5.

Figure 5:
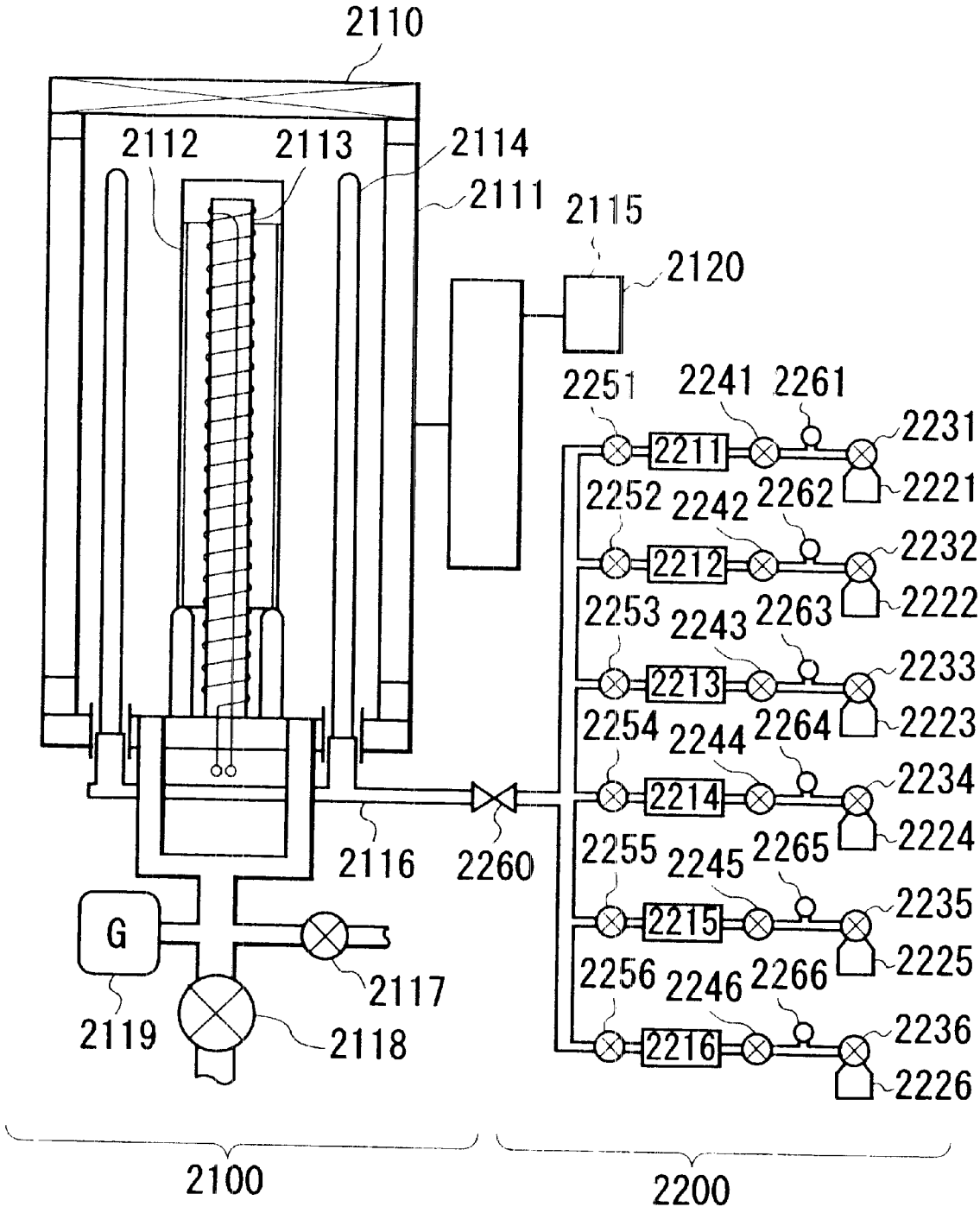

FIG. 5 illustrates an example of film deposition apparatus for producing an image-bearing member according to the RF-plasma CVD process using a high-frequency power supply.

The apparatus shown in FIG. 5 is roughly divided into a deposition unit 2100 including a reaction vessel 2110, a feed gas supply unit 2200 and an exhaust unit (not shown) for establishing a reduced pressure in the reaction vessel 2110. Within the reaction vessel 2110 in the deposition unit 2110, an electroconductive support 2112 connected to the ground, a heater 2113 for heating the electroconductive support and a feed gas introduction pipe 2114 are disposed, and a high-frequency power supply 2120 is connected to the reaction vessel 2110 via a high-frequency matching box 2115.

The feed gas supply unit 2200 includes feed gas cylinders 2221–2226, valves 2231–2236, 2261–2266, inlet valves 2241–2246, outlet valves 2251–2256 and mass flow controllers 2211–2216, for respective feed gases, such as $SiH_4$, $H_2$, $CH_4$, NO, $B_2H_6$ and $CF_4$. The gas cylinders 2221–2226 containing the respective feed gases are connected to the feed gas introduction pipe 2114 in the reaction vessel 2110 via an auxiliary valve 2260. The electroconductive support 2112 is disposed on an electroconductive table to be grounded.

An example procedure for production of an image-bearing member by using the apparatus of FIG. 5 will now be described.

A cylindrical electroconductive support 2112 is placed in the reaction vessel 2110 and the interior of the reaction vessel 2110 is evacuated by an exhaust unit (not shown, comprising, e.g., a vacuum pump). Then, the temperature of the electroconductive support 2112 is controlled at a desired temperature of 20–500° C. For the introduction of feed gases for forming an image-bearing member into the reaction vessel, the closure of the cylinder valves 2231–2236, and the reaction vessel leakage valve 2117, and the opening of the inlet valves 2241–2246 the outlet vales 2215 and the auxiliary valve 2260, and first checked, and then a main valve 2118 is opened to evacuate the reaction vessel 2110 and a gas supply pipe 2116.

Thereafter, when the reading of a vacuum gauge 2119 is lowered down to 0.67 mPa, the auxiliary valve 2260 and the outlet valves 2251–2256 are closed. Then, by opening the valves 2231–2236, the respective feed gases are introduced from the feed gas cylinders 2221–2226 and the respective gas pressures are adjusted at 2 kg/cm$^2$ (0.2 MPa) by the pressure controllers 2261–2266. Then, the inlet valves 2241–2246 are gradually opened to introduce the respective gases into the mass flow controller 2211–2216.

The preparation for film formation is completed by the above procedure, the formation of a photoconductor layer is first formed (in case where the photoconductor layer is a layer first formed by deposition on the electroconductive support).

When the electroconductive support 2112 has reached a desired temperature, necessary ones among the outlet valves 2251–2256 and the auxiliary valve 2260 are gradually opened to introduce desired feed gases via the feed gas introduction pipe 2114 into the reaction vessel 2110. Then, the respective feed gases are regulated at desired flow rates by the associated ones of the mass flow controllers 2211–2216. In this instance, the degree of opening of the main valve 2118 is regulated so as to provide a desired pressure of at most 133.3 Pa in the reaction vessel 2110 while referring to the vacuum gauge 2119.

When the internal pressure is made stable, the high-frequency power supply 2110 is set at a desired power, and a high-frequency power of, e.g., 13.56 MM in a frequency range of 1 MHz to 450 MHz is supplied via the high-frequency wave matching box 2115 to the cathode 2111 to cause high-frequency glow discharge. By the discharge energy, the respective feed gases introduced into the reaction vessel 2111 to deposit a photoconductor layer of a desired silicon-based non-single crystal material on the electroconductive support. When a desired layer thickness is reached, the high-frequency power supply is stopped, and the respective output vales 2251–2256 are closed to terminate the supply of the respective feed gases into the reaction vessel 2110, thereby completing the formation of the photoconductor layer having a composition and a thickness as mentioned above.

The formation of the surface layer on the photoconductor layer may be performed by basically repeating the above operation.

Figure 4:
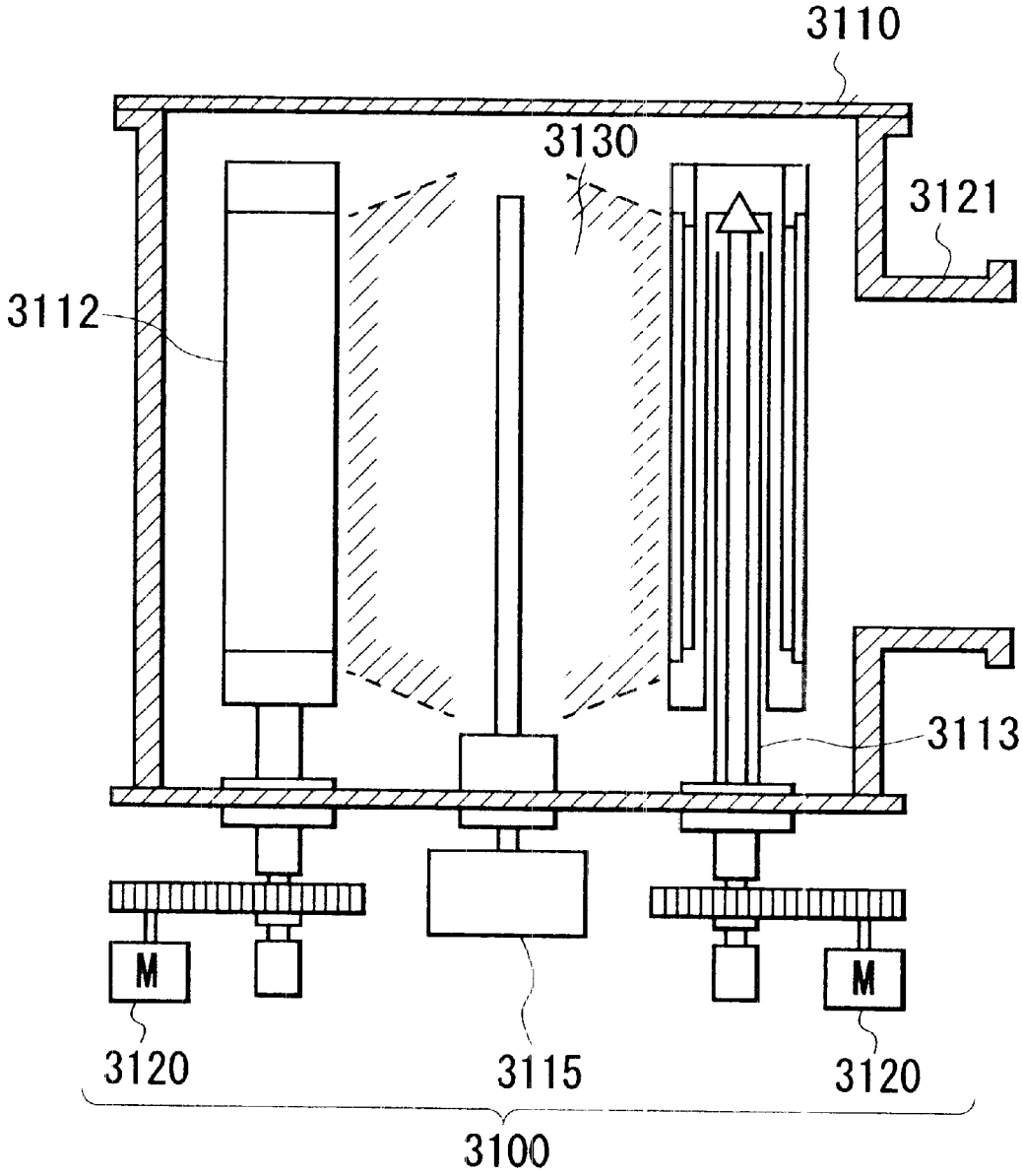
FIGS. 4 and 5 each illustrate an example of deposition apparatus for providing an electrophotographic photosensitive member used in the present invention.

FIG. 4 illustrates an example of film deposition apparatus for producing a photosensitive member according to the VHF plasma CVD process. The apparatus is organized by replacing the deposition unit 2110 in FIG. 5 with a deposition unit 3100 shown in FIG. 4.

The film formation by deposition according to the VHF-plasma CVD apparatus may be basically performed in a similar manner as the RF-plasma CVD process described with reference to FIG. 4. However, the high-frequency power is supplied from a VHF-power supply in a frequency range of 50 MHz to 450 MHz, e.g., at 105 MHz, and the pressure therefor is set to a level on the order of 13.3 mPa–13.3 Pa, lower than in the RF-plasma CVD process.

Referring to FIG. 4, electroconductive supports 3112 (only two are shown in FIG. 4 with one in a sectional state) are disposed within a reaction chamber 3110, and the interior of the reaction vessel 3110 is evacuated via an evacuation port 3121 by an evacuation apparatus (not shown, e.g., a diffusion pump). Then, the electroconductive supports 3112 are each heated by a heater 3113 for heating the electroconductive support 3112. Then, feed gases are introduced via a gas introduction pipe (not shown). In this apparatus, the feel gases thus introduced into a discharge space 3130 surrounded by the electroconductive supports 3112 are excited and decomposed by glow discharge caused by a VHF-power introduced into the discharge space 3130 through a watching box 3115, to form a desired deposition film on the electroconductive supports 3112. During the film deposition, the electroconductive supports 3112 are rotated at a desired rotation speed by motors 3120 therefor so as to allow a uniform layer formation.

Then, an outline of the electrophotographic image forming system (method and apparatus) will be described.

As mentioned above, in the electrophotographic image forming method according to the present invention, a specific a-Si photosensitive member is charged by contact charging and then subjected to exposure according to the image area exposure (IEA) mode to form an electrostatic latent image, which is then developed with a specific toner as described hereinafter. As far as these steps are included, the electrophotographic image forming method according to the present invention can include the step such as a fixing step and a pre-exposure step.

Further, as far as the above-mentioned image forming method can be performed, the electrophotographic image forming apparatus need not be restricted in other respects, can be prepared by utilizing known techniques and can suitably include various known means in addition to the means for performing the above functions.

Figure 3:
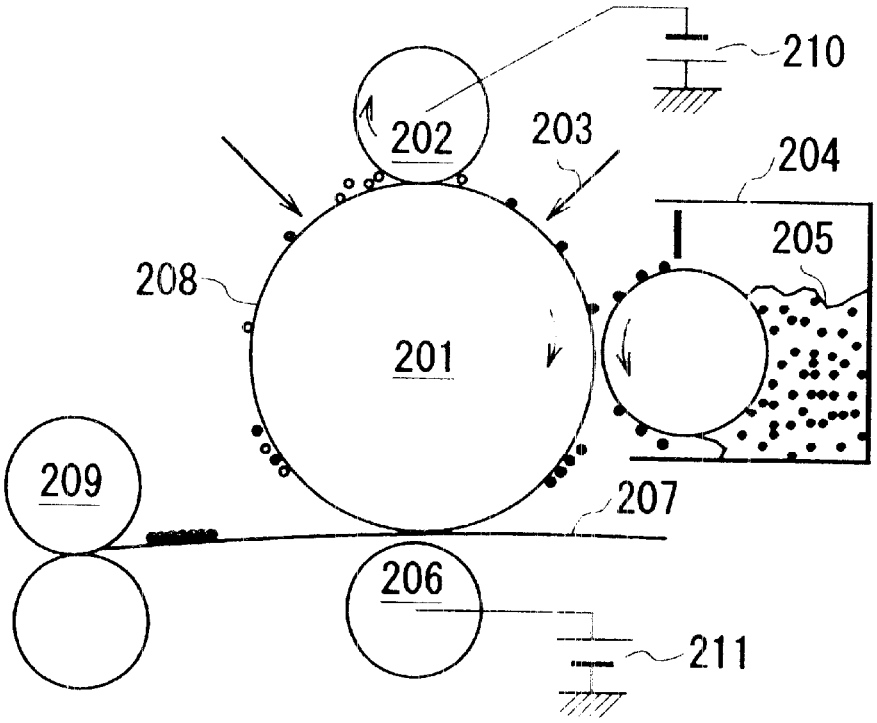
FIG. 3 illustrates an organization of an electrophotographic image forming apparatus according to an embodiment of the present invention.

FIG. 3 is a schematic illustration of an embodiment of the electrophotographic image forming apparatus according to the present invention.

According to this embodiment, the electrophotographic image forming apparatus includes a rotating image-bearing member, a charge means for surface-charging the image-bearing member, a latent image forming means for forming an electrostatic latent image on the charged surface of the image-bearing member, a developing means for attaching the surface of the image-bearing member to develop the electrostatic latent image as a toner image, a transfer means for transferring the toner image onto a recording medium, and a fixing means for fixing the toner image onto the recording medium.

Image-bearing Member

Referring to FIG. 3, the electrophotographic image forming apparatus includes a rotating drum-type electrophotographic image-bearing member (a-Si photosensitive member) 201. The apparatus (e.g. a copying machine or a printer) has adopted the reversal development scheme, and the image-bearing member 201 is a negative polarity image-bearing member of, e.g., 30 mm in diameter, having thereon the above-mentioned surface layer and photoconductor layer, etc. The image-bearing member 201 may be driven in rotation at a surface speed of, e.g., 200 mm/sec in an indicated arrow direction.

Charging

The image forming apparatus further includes an electroconductive elastic roller (charging roller) 202 as a flexible or elastic contact charging member disposed in contact with the image-bearing member 201 at a prescribed pressing force at a charging nip with the image-bearing member 201. The charging roller 201 is preliminarily coated with charging particles on its outer surface so that the charging particles are present at the charging nip with the image-bearing member 201.

According to this embodiment, the charging roller 202 is driven in rotation in an indicated arrow direction, i.e., in an opposite direction and at a peripheral speed of 100% with respect to the peripheral moving direction and speed, respectively, of the image-bearing member 201 at the charging nip, thus providing a relative speed difference with the image-bearing member 201 surface. The charging roller 202 is supplied with a prescribed bias voltage from a bias voltage supply 210. As a result, the outer surface of the image-bearing member is uniformly contact-charged to a prescribed potential of a prescribed polarity (i.e., a negative polarity) according to the injection charging scheme.

In this embodiment, a charging bias voltage is applied from the charging bias voltage supply 210 to the charging roller 202 so as to provide a uniform surface potential on the image-bearing member 201 of 150–800 volts, preferably 250–600 volts, more preferably 300–450 volts, respectively in terms of an absolute value, as measured at a developing position. Below 150 volts, the toner cannot be sufficiently transferred for development from the toner-carrying member to the a-Si photosensitive member and accumulated on the toner-carrying member to cause a difficulty, such as an image density lowering, in some cases. On the other hand, above 800 volts, the current passage to the charging member is increased to accelerate the deterioration of the charging member and partial minute discharge is liable to occur because of the large applied voltage.

Details of the charging roller, the charging particles and the injection charging will be discussed hereinafter.

Exposure

The uniformly charged image-bearing member 201 is then exposed to scanning laser light 203 which has been emitted from a laser beam scanner (exposure device) as a latent image forming means including a laser diode, a polygonal mirror, etc., after intensity-modification corresponding to time-serial electric digital signals carrying objective image data, thereby forming an electrostatic latent image corresponding to the objective image data on the surface of the image-bearing member 201.

The light source forming the electrostatic latent image forming means is not restricted to the above-mentioned laser beam scanner but can be an LED array. In this case, LEDs (light-emitting diodes) at positions corresponding to objective image data are sequentially turned on to form an electrostatic latent image thereon. More specifically, an image-forming part (where a toner is to be attached in the developing step) of the charged surface of the image-bearing member is exposed to light to provide an attenuated potential thereat to form an electrostatic latent image, i.e., according to the image area exposure (IAE) mode.

Development

The image forming apparatus further includes a developing device 204 as the developing means. The electrostatic latent image formed on the image-bearing member 201 is developed with a toner 205 (negatively chargeable toner in this embodiment) by the developing device 204. The developing device 204 is not particularly limited if it allows cleaning operation in addition to developing operation. For example, the developing device 204 may include a known developing means including a developer container containing a toner having an opening, an electroconductive developing sleeve for carrying and conveying the toner disposed at the opening of the developer container, a magnetic field-generating means, such as a magnet, for generating a plurality of magnetic fields disposed and fixed within the developing sleeve, and a toner thickness-regulation member for regulating a thickness of a toner layer formed on the developing sleeve (e.g., an elastic blade disposed in abutment with the developing sleeve or a metal blade disposed apart from the developing sleeve and regulating the toner layer thickness by concentrating the magnetic field at its edge), thus applying a desired developing bias voltage to the developing sleeve.

Transfer

The image forming apparatus further includes a transfer roller 26 having a medium electrical resistance as the (contact) transfer means. The transfer roller 206 is appropriately abutted against the image-bearing member 201 so as to form a prescribed transfer nip portion therebetween. To the nip portion, a transfer(-receiving) material 207 as a recording medium is supplied from a paper supply part (not shown) at a prescribed timing wile applying a prescribed transfer bias voltage (positive voltage in this embodiment) to the transfer roller 206. As a result, the developed toner image (negatively charged in this embodiment) carried on the image-bearing member 201 is successively transferred onto the surface of the transfer material 207 supplied to the nip portion under the action of electrostatic and pressing forces. Incidentally, in the present invention, it is also possible to use a known transfer means in addition to the above-described transfer roller 206.

Fixation

The image forming apparatus further includes a fixing device 209 using a hot pressure fixation scheme. The transfer material 207 onto which the toner image carried on the image-bearing member 201 has been transferred is separated from the image-bearing member surface to be conveyed into the fixing device 209 comprising a pair of opposing rollers. The toner image transferred onto the transfer material 207 is fixed thereon by the fixing device 209 and discharged outside the image forming apparatus as a copy or a print (image formation product). In the present invention, as the fixing means, it is also possible to suitably employ known various developing means other than the above fixing device 209.

Charging Roller

In this embodiment, the charging roller 202 as the contact charging member is prepared by forming a medium-resistance layer of rubber or foamed material on a core metal. The medium-resistance layer may, e.g., comprise a resin (e.g., urethane resin), electroconductive particles (e.g., carbon black), a sulphidizing agent and a foaming agent and formed in a roller shape on the core metal, followed by surface polishing as desired.

In a specific embodiment, the charging roller 202 had a roller resistance of 100 kohm.cm as measured in such state that the charging roller 202 is pressed against an aluminum support having an outer diameter of 30 mm so as to exert a total pressure of 1 kg on the core metal thereof while applying a voltage of 100 volts between the core metal and the aluminum support.

In the present invention, it is important that the charging roller 202 as the contact charging member functions as an electrode. More specifically, the charging roller is required to ensure a sufficient contact state with a member to be charged by providing the charging roller with an elasticity and at the same time, is also required to have a lower resistance sufficient to charge the member to be charged. On the other hand, it is necessary to prevent an occurrence of leakage of voltage in the case where the member to be charged has a defective portion such as pinholes having a lower withstand voltage. In the case of using the electrophotographic image-bearing member as the member to be charged, the charging roller may preferably have a volume resistivity of $1\times10^3$–$1\times10^8$ ohm.cm, particularly $10^4$–$10^7$ ohm.cm, in order to obtain sufficient charging and leakage resistance performances. If the volume resistivity of the charging roller is outside the above range, the above-mentioned charging and leakage resistance performances are not achieved in some cases.

The charging roller 202 may desirably have a porous surface, such as one with minute unevenness capable of holding charging particles.

The charging roller 202 may preferably have an Asker C hardness of at most 50 deg., more preferably 25–50 deg., since a lower hardness leads to an unstable shape to impair the contact characteristic with the member to be charged and on the other hand, a higher hardness fails to ensure a charging nip portion between the charging roller and the member to be charged, thus impairing a minute contact state with the member to be charged.

The Asker C hardness of the charging roller 202 may be measured by using an Asker C micro rubber hardness meter (made by Kobunshi Keiki K.K.) in such a manner that a rubber hardness at arbitrary 5 points on the charging roller is measured to determine an Asker C hardness as an average of 5 measured values.

The material for the charging roller 202 may include not only an elastic foamed material but also other elastic materials, such as EPDM (ethylene propylene terpolymer), urethane rubber, NBR (nitrile-butadiene rubber, silicone rubber and IR (isoprene rubber), containing therein an electroconductive substance (e.g., carbon black or metal oxide) in order to effect resistivity control, and foamed material of these rubber materials. It is also possible to effect resistivity control by using an ion conductive material without dispersing the electroconductive substance.

The charging roller 202 is pressed against the image-bearing member 201 (as the member to be charged) at a prescribed pressing force to form a charging nip portion with a width of several mm in this embodiment.

Charging Particles

The charging particles used in the present invention may principally comprise electroconductive particles having an average particle size of 0.1–10 μm. If the average particle size of the charging particles is smaller, a content of the charging particles in the toner has to be set to be smaller. Accordingly, below 0.1 μm, an effective amount of the charging particles cannot be ensured, thus failing to supply an amount of the charging particles sufficient to overcome charging inhibition by attachment or contamination of an insulating transfer residual toner onto the contact charging member in the charging step to well charge the image-bearing member. As a result, charging failure is liable to occur. For this reason, the electroconductive (charging) particles may preferably have an average particle size of at least 0.15 μm, more preferably 0.2–5 μm.

If the particle size of the charging particles is above 10 μm, charging particles detached from the charging member cause light-interruption or diffusion of exposure light for writing an electrostatic latent image, thus resulting in a defective electrostatic latent image to lower a resultant image quality in some cases. Further, the average particle size of the charging particles is larger, the number of particles per unit weight is decreased, the content of the charging particles in the entire toner is required to be increased in order to successively supply the charging particles to the nip portion between the charging member and the image-bearing member or a charging region in proximity thereto thereby to cause the charging particles thereat in view of decrease and/or deterioration of the charging particles caused by, e.g., detachment thereof from the charging member or in order to stably provide a good chargeability while retaining an intimate contact state of the contact charging member with the image-bearing member via the charging particles. However, when the content of the charging particles is excessively increased, the developing characteristic is lowered particularly in a high-humidity environment, thus causing a lowering in image density or toner scattering.

In this embodiment, the charging articles may, e.g., comprise (electroconductive) zinc oxide particles having a volume resistivity of $10^7$ ohm.cm and an average particle size of 1.5 μm.

In the present invention, the average particle size and particles size distribution of charging particles described herein are based on values measured in the following manner. A laser diffraction-type particle size distribution measurement apparatus ("Model LS-230", available from Beckman Coulter Electronics Inc.) is equipped with a liquid module, and the measurement is performed in a particle size range of 0.04–2000 μm to obtain a (volume-basis) particle size distribution. For the measurement, a minor amount of surfactant is added to 10 ml of pure water and 10 mg of a sample electroconductive fine powder (charging particles) is added thereto, followed by 10 min. of dispersion by means of an ultrasonic disperser (ultrasonic homogenizer) to obtain a sample dispersion liquid, which is subjected to a single time of measurement for 90 sec.

The particle size and particle size distribution of charging particles used in the present invention may for example be adjusted by setting the production method and conditions so as to produce primary particles of the charging particles having desired particle size and its distribution. In addition, it is also possible to agglomerate smaller primary particles or pulverize larger primary particles or effect classification. It is further possible to obtain such electroconductive particles by attaching or fixing electroconductive fine particles onto a portion or the whole of base particles having a desired particle size and its distribution, or by using particles of desired particle size and distribution containing an electroconductive component dispersed therein. It is also possible to provide charging particles with a desired particle size and its distribution by combining these methods.

In the case where the charging particles are composed of agglomerate particles, the particle size of the charging particles is determined as the particle size of the agglomerate. The charging particles in the form of agglomerated secondary particles can be used as well as that in the form of primary particles. Regardless of its agglomerated form, the charging particles can exhibit its desired function of charging promotion by presence in the form of the agglomerate in the charging section at the nip portion (contact position) between the charging member and the image-bearing member or in a region in proximity thereto.

The charging particles may preferably have a resistivity of at most $10^9$ ohm.cm. If the charging particles have a resistivity exceeding $10^9$ ohm.cm, the effect of promoting the good chargeability of the image-bearing member cannot be obtained in some cases, even if the charging particles are present at the contact position between the charging member and the image-bearing member or in the charging region in the vicinity thereof so as to retain an intimate contact via the charging particles between the contact charging member and the image-bearing member when used in an image forming method including the developing-cleaning step.

In order to sufficiently attain the effect of promoting the chargeability of the image-bearing member owing to the charging particles, thereby stably accomplishing good uniform chargeability of the image-bearing member, it is preferred that the charging particles have a resistivity lower than the resistivity at the surface or at contact part with the image-bearing member of the contact charging member. The charging particles may more preferably have a resistivity of $10^6$ ohm.cm or below in order to effectively perform charging of the image-bearing member by overcoming charging inhibition caused due to attachment or contamination of the transfer residual toner onto the contact charging member. On the other hand, an excessively lower resistivity of the charging particles also provides inferior results, so that the charging particles may preferably have a resistivity of at least $1\times10^1$ ohm.cm in order to charge the charging particles to allow development at a non-image portion, thus promoting charging performance. In this embodiment, the charging particles have a resistivity of $1\times10^7$ ohm.cm.

The resistivity of charging particles may be measured by the tablet method and normalized. More specifically, ca. 0.5 g of a powdery sample is placed in a cylinder having a bottom area of 2.26 $cm^2$ and sandwiched between an upper and a lower electrode under a load of 15 kg. In this state, a voltage of 100 volts is applied between the electrodes to measure a resistance value, from which a resistivity value is calculated by normalization.

It is also preferred that the charging particles are white or nearly so as to prevent the obstruction of exposure light in the latent image-step. The charging particles may also preferably be non-magnetic. Further, in view of partial transfer for the charging particles from the image-bearing member to the transfer material, the charging particles may desirably be transparent, white or only pale-colored in the color image forming process. It is further preferred that the charging particles show a transmittance of at least 30%, with respect to imagewise exposure light used for latent image formation, as measured in the following manner.

A sample of electroconductive fine powder is attached onto an adhesive layer of a one-side adhesive plastic film to form a mono-particle densest layer. Light flux for measurement is incident vertically to the powder layer, and light transmitted through to the backside is condensed to measure the transmitted quantity. A ratio of the transmitted light to a transmitted light quantity through an adhesive plastic film alone is measured as a net transmittance. The light quantity measurement may be performed by using a a transmission-type densitometer (e.g., "310T", available from X-Rite K.K.).

The charging particles used in the present invention may for example comprise: carbon fine powder, such as carbon black and graphite powder; and fine powders of metals, such as copper, gold, silver, aluminum and nickel; metal oxides, such as zinc oxide, titanium oxide, tin oxide, aluminum oxide, indium oxide, silicon oxide, magnesium oxide, barium oxide, molybdenum oxide, iron oxide, and tungsten oxide; and metal compounds, such as molybdenum sulfide, cadmium sulfide, and potassium titanate; an complex oxides of these. Among the above, it is preferred that the charging particles comprise fine particles of metal oxide such as zinc oxide, tin oxide or titanium oxide.

Further, it is also possible to use fine particles of metal oxide doped with an element, such as antimony or aluminum, in order to control a resistivity of the electroconductive oxide metal, or fine particles surface-coated with an electro-conductive material. Examples of such composite electroconductive particles may include: titanium oxide fine particles surface-treated with antimony-tin oxide, antimony-doped stannic oxide fine particles and stannic oxide fine particles. It is also possible to use various electroconductive particles, such as electroconductive inorganic particles of metal oxide including titanium oxide or alumina; mixture of these particles with an organic compound; and those which have been surface-treated.

These may be used singly or in mixture of two or more species.

Commercially available examples of electroconductive titanium oxide fine powder coated with antimony-tin oxide may include: "EC-300" (Titan Kogyo K.K.); "ET-300", "HJ-1" and "HI-2" (Ishihara Sangyo K.K.) and "W-P" (Mitsubishi Material K.K.).

Commercially available examples of antimony-doped electroconductive tin oxide fine powder may include: "T-1" (Mitsubishi Material K.K.) and "SN-100P" (Ishihara Sangyo K.K.).

Commercially available examples of stannic oxide fine powder may include: "SH-S" (Nippon Kagaku Sangyo K.K.).

Further, the charging particles may include other fine powder in addition to the above-mentioned electroconductive particles (fine powder) in order to control various properties of the charging particles, such as electroconductivity, light-transmissive properties, color tone, specific gravity, and flowability. These fine powder may have no electroconductivity.

In the present invention, the charging particles may be caused to be present at the above-mentioned contact position by providing the charging means with a replenishment means for replenishing charging particles onto the charging roller surface or by externally adding charging particles to the toner for indirect supply to the contact position.

Injection Charging

By placing the charging particles at the charging nip portion (contact position) between the image-bearing member 201 and the charging roller 202 (as the contact charging member), it becomes possible to readily and effectively bring even a charging roller, which per se has not readily caused to be in contact with the image-bearing member 201 with a peripheral speed difference due to a large frictional resistance based on a lubricating effect of the charging particles, into contact with the surface of the image-bearing member 201 readily and effectively at different peripheral speeds while retaining the charging particles between the image-bearing member 201 and the charging roller 202, thus ensuring intimate contact state therebetween at a high frequency.

By providing a sufficient relative speed difference between the charging roller 202 and the image-bearing member 201, it is possible to remarkably increase the frequency of contact of the charging particles with the image-bearing member 201 at the charging nip portion between the charging roller 202 and the image-bearing member 201, thus realizing a close contact state. As a result, the charging particles disposed at the charging nip portion are rubbed onto the entire image forming surface of the image-bearing member 201, thus allowing direct injection of electric charges into the image-bearing member 201. As a result the contact charging of the image-bearing member 201 by the charging roller 202 is predominantly based on the injection charging mechanism.

In order to provide the relative speed difference with the image-bearing member 201, the charging roller 202 is driven in rotation or fixed. In a preferred embodiment, the charging roller 202 is driven in rotation in a direction opposite to a rotation direction (peripheral-moving direction) of the image-bearing member 201.

Toner

The magnetic toner used in the present invention may be prepared by known methods using known ingredients so long as the above-mentioned characteristic properties thereof are fulfilled.

The magnetic toner used in the present invention may be formed through a pulverization process. The resultant toner particles obtained by the pulverization process (hereinafter, referred to as "pulverization toner") are generally caused to have indefinite shapes. Accordingly, in order to obtain a circularity of at least 0.950 (preferably at least 0.970) as an essential requirement of the magnetic toner used in the present invention, the toner particles have to be subjected to some special mechanical or thermal treatment. For this reason, in the present invention, toner particles may preferably be produced through a suspension polymerization process (hereinafter, the thus-produced toner is referred to as "polymerization toner"). However, the magnetic toner used in the present invention may be a pulverization toner if the toner has a circularity of at least 0.950, thus attaining desired effects.

The polymerization toner has a substantially uniform spherical shape with less irregularity in particle size, thus being excellent in flowability. Further, the polymerization toner causes no migration of a colorant to the particle surface to allow uniform triboelectric chargeability, thus being advantageous to realization of high image qualities. Further, the polymerization toner can enclose therein a wax component to provide a good fixability and excellent anti-offset characteristic. For this reason, the polymerization toner has been gradually employed in a high-quality image forming apparatus.

In order to produce the polymerization toner used in the electrophotographic image forming method of the present invention, a mixture of a polymerizable monomer and a magnetic material, and other toner components a wax (release agent), a charge control agent, a colorant, a crosslinking agent, and a plasticizer, as desired; further optional ingredients, such as an organic solvent polymer, an additive polymer, and dispersing agent, may generally be subjected to uniform dissolution or dispersion by a dispersing machine, such as a homogenizer, a ball mill, a colloid mill, or an ultrasonic dispersing machine, and a resultant monomeric mixture system may be suspended in an aqueous medium (suspension polymerization).

At this time, it is preferred to use a high-speed dispersing machine, such as a high-speed stirrer or an ultrasonic dispersing machine to form droplets of the monomeric mixture in desired size at a stroke in order to provide toner particles of a narrower (uniform) particle size distribution.

A polymerization initiator may be added to the polymerization system by adding it to the monomeric mixture together with the other ingredients for providing the monomeric mixture or just before dispersing the monomeric mixture in the aqueous medium. Alternatively, it is also possible to add such a peroxide polymerization initiator in solution within a polymerizable monomer or another solvent into the polymerization system just after the formation of the droplets of the monomeric mixture and before the initiation of the polymerization. These toner ingredients may be those used in an ordinary toner production process.

The polymerization toner may generally be produced at a polymerization (reaction) temperature of at least 40° C., preferably 50–90° C., in order to completely enclose the release agent or wax within toner particles based on phase separation phenomenon. It is possible to increase the polymerization temperature up to 90–150° C. in a final stage of the polymerization reaction in order to effect complete consumption of the remaining polymerizable monomer.

The magnetic toner used in the present invention may also be produced through other processes including a dispersion polymerization process wherein toner particles are directly formed by using an aqueous organic solvent which is soluble in a monomer but is insoluble in a polymer; an emulsion polymerization wherein a monomeric mixture is directly polymerized in the presence of an aqueous polar polymerization initiator; and a process wherein polymer particles obtained through, e.g., the emulsion polymerization is agglomerated by association.

After the polymerization, the polymerized toner particles are filtered, washed and dried in an ordinary manner. Then, inorganic fine powder is blended with the toner particles to be attached onto the surface of toner particles, thus obtaining a magnetic toner used in the present invention. In a preferred embodiment of the present invention, the toner production process may desirably include a classification step for remaining coarse and fine powder fractions of the toner particles.

The magnetic toner obtained through the suspension polymerization comprises toner particles individually having a substantially spherical shape, thus readily providing an average circularity of at least 0.950, preferably at least 0.970. As a result, it is possible to readily produce the magnetic toner satisfying the average circularity of at least 0.950 as one of essential physical properties thereof. The thus-obtained magnetic toner also has a relatively uniform charge distribution, thus exhibiting a high transferability.

As described above, the magnetic toner used in the present invention comprises toner particles comprising at least a binder resin and a magnetic material and inorganic fine powder. The binder resin used in the present invention may include various known binder resins. Examples of such a binder resin may include: homopolymers of styrene and its substituted derivatives, such as polystyrene and polyvinyltoluene; styrene copolymers, such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenolic resin, aliphatic or alicyclic hydrocarbon resins, and aromatic petroleum resin. These resins may be used singly or in combination of two or more species.

Examples of polymerizable monomer suitably used in the suspension polymerization described above may include: styrene monomers, such as styrene, o-methylstyrene, m-methylstyrene, p-methylstyrene, p-methoxystyrene and p-ethylstyrene; acrylate esters, such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters, such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile and acrylamide. These monomers may be used singly or in mixture. Among these, styrene or a styrene derivative may preferably be used singly or in mixture with another monomer so as to provide a magnetic toner with good developing performances and continuous image forming performance.

Examples of the polymerization initiator usable for polymerizing the above-mentioned polymerizable monomers may include: azo- or diazo-type polymerization initiators, such as 2,2'-azobis-(2,4-dimethylvaleronitrile), 2,2'-azobisisobutyronitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, and t-butyl peroxy-2-ethylhexanoate. These may be used singly or in mixture.

A crosslinking agent usable for polymerizing the polymerizable monomers may for example be a compound having two or more polymerizable double bonds. Examples thereof may include various known crosslinking agents including: aromatic divinyl compounds, such as divinylbenzene, and divinylnaphthalene; carboxylate esters having two double bonds, such as ethylene glycol diacrylate, ethylene glycol dimethacrylate, and 1,3-butane diol dimethacrylate; divinyl compounds, such as divinylaniline, divinyl ether, divinyl sulfide and divinyl sulfone; and compounds having three or more vinyl groups. These may be used singly or in mixture.

Into the suspension polymerization system, a dispersion stabilizer may be added. As the dispersion stabilizer, it is possible to use a known surfactant or organic or inorganic dispersion agent. Among these, an inorganic dispersing agent may preferably be used because it is less liable to result in excessively small particles which can cause some image defects, its dispersion function is less liable to be impaired even at a temperature change because its stabilizing function principally relies on its stearic hindrance, and also it can be readily removed by washing to be less liable to adversely affect the resultant toner performance.

Examples of such an inorganic dispersing agent may include: polyvalent metal phosphates, such as calcium phosphate, magnesium phosphate, aluminum phosphate, and zinc phosphate; carbonates, such as calcium carbonate and magnesium carbonate; inorganic salts, such as calcium metasilicate, calcium sulfate, and barium sulfate; and inorganic oxides, such as calcium hydroxide, magnesium hydroxide, aluminum hydroxide, silica bentonite, and alumina. These may be used singly or in mixture.

Examples of such a surfactant may include: sodium dodecylbenzenesulfate, sodium tetradecyl-sulfate, sodium pentadecylsulfate, sodium octylsulfate, sodium oleate, sodium laurate, sodium stearate, and potassium stearate. These may be used singly or in mixture.

Examples of the organic dispersing agent may include polyvinyl alcohol, gelatin, methylcellulose, methylhydroxypropylcellulose, ethylcellulose, sodium carboxymethylcellulose, polyacrylic acid and its sodium salt, and starch. These may be used singly or in mixture.

The magnetic toner used in the present invention may further contain a release agent or waxes for controlling a releasability or a plasticity.

Examples of such waxes usable in the magnetic toner used in the present invention may include: petroleum waxes and derivatives thereof, such as paraffin wax, microcrystalline wax and petrolactum; montan wax and derivatives thereof; hydrocarbon wax by Fischer-Tropsch process and derivative thereof; polyolefin waxes as represented by polyethylene wax and derivatives thereof; and natural waxes, such as carnauba wax and candelilla wax and derivatives thereof. The derivatives may include oxides, block copolymers with vinyl monomers, and graft-modified products. Further examples may include: higher aliphatic alcohols, fatty acids, such as stearic acid and palmitic acid, and compounds of these, acid amide wax, ester wax, ketones, hardened castor oil and derivatives thereof, vegetable waxes and animal waxes. These may be used singly or in mixture.

The magnetic toner used in the present invention can further contain a charge control agent so as to control the chargeability.

Specific examples of negative charge control agents may include: metal compounds of aromatic carboxylic acids, such as salicylic acid, alkylsalicylic acids, dialkylsalicylic acids, naphthoic acid, and dicarboxylic acids; metal salts or metal complexes of azo-dyes and azo pigments; polymeric compounds having a sulfonic acid group or carboxylic acid group in side chains; boron compounds, urea compounds, silicon compounds, and calixarenes.

Positive charge control agents may include: quaternary ammonium salts, polymeric compounds having such quaternary ammonium salts in side chains, quinacridone compounds, nigrosine compounds and imidazole compounds.

The above charge control agents may be used singly or in mixture.

The magnetic toner used in the present invention may further contain a colorant including magnetic or non-magnetic inorganic compounds, and known dyes and pigments. Specific examples thereof may include: particles of ferromagnetic metals, such as cobalt and nickel, alloys of these with chromium, manganese, copper, zinc, aluminum and rare earth elements; hematite, copper, zinc, aluminum and rare earth elements; hematite, titanium black, nigrosine dyes/pigments, carbon black and phthalocyanine. These may be used singly or in mixture. The colorant may be subjected to hydrophobicity-imparting treatment (hydrophobization) similarly as in the magnetic material and inorganic fine powder described below.

The magnetic material contained in the magnetic toner used in the present invention may include known magnetic materials principally comprising, e.g., iron oxides, such as triiron tetroxide and γ-iron oxide. These may be used singly or in mixture. The magnetic material may further contain other elements, such as phosphorous, cobalt, nickel, copper, magnesium, manganese, aluminum and silicon. By appropriately selecting the species and amount of the magnetic material used, it is possible to adjust a saturation magnetization of the magnetic toner used in the present invention.

The magnetic material may preferably be subjected to the hydrophobization with a known treating agent in an ordinary manner. Such a treating agent for hydrophobization may include a coupling agent such as a silane coupling agent or a titanate coupling agent, particularly the silane coupling agent, which is bonded to the magnetic material surface while being hydrolyzed in an aqueous medium.

Examples of such a silane coupling agents may include: vinyltrimethoxysilane, vinyltriethoxysilane, gamma-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane. These may be used singly or in mixture.

The inorganic fine powder used in the present invention is contained in the magnetic toner in order to control the flowability thereof and may, e.g., comprise fine powder of at least one species selected from the group consisting of silica, titania and alumina.

For example, silica fine powder may be dry-process silica (sometimes called fumed silica) formed by vapor phase oxidation of a silicon halide or wet process silica formed from water glass. However, dry process silica is preferred because of fewer silanol groups at the surface and inside thereof and also fewer production residues such as $Na_2O$ and $SO_3^{2-}$. The dry process silica can be in the form of complex metal oxide (double oxide) powder with other metal oxides for example by using another metal halide, such as aluminum chloride or titanium chloride together with silicon halide in the production process.

The inorganic fine powder may preferably be added in a proportion of 0.1–3.0 wt. % of the magnetic toner particles. Below 0.1 wt. %, the addition effect thereof (improvement in flowability and chargeability of the toner) is scarce, and above 3.0 wt. %, the fixability of the magnetic toner is lowered.

The inorganic fine powder used in the present invention may preferably have an average primary particle size of 4–100 nm. Below 4 nm, the inorganic fine powder is caused to have a strong agglomeratability to damage the image-bearing member, thus being liable to cause image defects. Above 100 nm, a sufficient flowability-improving effect to the magnetic toner is not attained to cause image defects resulting from insufficient charge of the magnetic toner.

The average primary particle size of the inorganic fine powder may be measured by various known methods. Specifically, a magnetic toner sample is photographic in an enlarged form through a scanning electron microscope (SEM) equipped with an elementary analyzer such a XMA to provide an ordinary SEM picture and also an XMA picture mapped with elements contained in the inorganic fine powder. Then, by comparing these pictures, the sizes of 100 or more inorganic fine powder primary particles attached onto or isolated from the magnetic toner particles are measured to provide a number-average particle size.

The inorganic fine powder may preferably have a specific surface area (SBET) of 20–400 $m^2/g$ as measured by the nitrogen adsorption BET method, e.g., the BET multi-point method using a specific surface area meter ("Autosorb 1", made by Yuasa Ionix K.K.).

The BET specific surface area (SBET) of the inorganic fine powder may be measured before or after the hydrophobization described specifically below since $S_{BET}$ is little affected by the hydrophobization. However, in view of actual physical properties of the inorganic fine powder, the $S_{BET}$ value thereof may preferably be measured after the hydrophobization.

The inorganic fine powder may preferably be subjected to hydrophobization.

A hydrophobization agent may appropriately selected depending on the species of the inorganic fine powder. Examples of the hydrophobization agent may include known treating agents including the above-mentioned coupling agent such as silane coupling agent or titanate coupling agent, and a silicone oil, particularly a silicone oil. he hydrophobization may be performed in the same manner as in the case of the magnetic material described above.

Examples of the silicone oil for the hydrophobization may include dimethylsilicone oil, methylphenylsilicone oil, α-methylstyrene-modified silicone oil, chlorophenylsilicone oil and fluorine-modified silicone oil. These may be used singly or in mixture.

The magnetic toner used in the present invention has an average circularity of at least 0.950 (preferably at least 0.970), thus having a shape closer to a sphere. If the magnetic toner has an average circularity of at least 0.950, the magnetic toner particles are caused to have a small contact area with the image-bearing member, thus resulting in a small force of attachment force attributable to image force and van der Waals force onto the photosensitive member. As a result, a high transferability can be attained.

If the magnetic toner has a higher average circularity, toner ears formed on a toner-carrying member at a developing section become fine and dense to provide a uniform charge, thus allowing a faithful development to an electrostatic latent image. As a result, improvement in image quality is expected. On the other hand, if the circularity is below 0.950, the above effect is scarce.

The average circularity is used as a quantitative measure for evaluating particle shapes and based on values measured by using a flow-type particle image analyzer ("FPIA-1000", mfd. by Toa Iyou Denshi K.K.). A circularity (Ci) of each individual particle (having a circle equivalent diameter (DCE) of at least 3.0 μm) is determined according to an equation (1) below, and the circularity values (Ci) are totaled and divided by the number of total particles (m) to determine an average circularity (Cav) as shown in an equation (2) below:

$$\text{Circularity } Ci = L_0/L, \tag{1}$$

wherein L denotes a circumferential length of a particle projection image, and $L_0$ denotes a circumferential length of a circle having an area identical to that of the particle projection image.

$$\text{Average circularity } (Cav) = \sum_{i=1}^{m} Ci/m \tag{2}$$

Incidentally, for actual calculation of an average circularity (Cav), the measured circularity values (Ci) of the individual particles were divided into 61 classes in the circularity range of 0.40–1.00, and a central value of circularity of each class was multiplied with the frequency of particles of the class to provide a product, which was then summed up to provide an average circularity. It has been confirmed that the thus-calculated average circularity (Cav) is substantially identical to an average circularity value obtained (according to Equation (2) above) as an arithmetic mean of circularity values directly measured for individual particles without the above-mentioned classification adopted for the convenience of data processing, e.g., for shortening the calculation time.

More specifically, the above-mentioned FPIA measurement is performed in the following manner. Into 10 ml of water containing ca. 0.1 mg of surfactant, ca. 5 mg of magnetic toner sample is dispersed and subjected to 5 min. of dispersion by application of ultrasonic wave (20 kHz, 50

W), to form a sample dispersion liquid containing 5,000–20,000 particles/μl. The sample dispersion liquid is subjected to the FPIA analysis for measurement of the average circularity (Cav) with respect to particles having $D_{CE} \geqq 3.0$ μm.

The average circularity (Cav) used herein is a measure of roundness, a circularity of 1.00 means that the magnetic toner particles have a shape of a perfect sphere, and a lower circularity represents a complex particle shape of the magnetic toner.

Herein, only particles having a circle-equivalent diameter ($D_{CE}=L/\pi$) of at least 3 μm are taken for the circularity measurement because particles smaller than 3 μm include a substantial amount of external additives and the inclusion of such particles can distort the circularity characteristic of magnetic toner particles.

From the viewpoints of developing performance, transferability and chargeability, the magnetic toner used in the present invention may preferably have a weight-average particle size of 3–10 μm.

A magnetic toner having a weight-average particle size (D4) below 3 μm is liable to cause a lower transferability, thus failing to retain a uniform chargeability. If the D4 is larger than 10 μm, the developing performance is lowered, thus failing to form high-quality images.

The particle size distributions and average particle sizes may be measured by using various apparatus for measuring D4 of powdery materials, such as Coulter counter Model TA-II or Coulter Multicizer (respectively available from Coulter Electronics, Inc.). Herein, these values are determined based on values measured by using Coulter Multicizer connected to an interface (made by Nikkaki K.K.) and a personal computer ("PC9801", made by NEC K.K.) for providing a number-basis distribution and a volume-basis distribution in the following manner. A 1%-aqueous solution is prepared as an electrolytic solution by sing a reagent-grade sodium chloride (it is also possible to use ISOTON R-II (available from Coulter Scientific Japan K.K.)). For the measurement, (e.g., 0.1 to 5 ml of) a surfactant, preferably a solution of an alkylbenzenesulfonic acid salt, is added a a dispersant into (e.g., 100 to 150 ml of) the electrolytic solution, and (e.g., 2–20 mg) of a sample toner is added thereto. The resultant dispersion of the sample in the electrolytic solution is subjected to a dispersion treatment (e.g., for ca. 1–3 minutes) by means of an ultrasonic disperser, and then subjected to measurement of particle size distribution of particles of at least 2 μm by using the above-mentioned Coulter counter with a 100 μm-aperture to obtain a volume-basis distribution and a number-basis distribution. From the volume-basis distribution, a weight-average particle size (D4) is calculated.

The magnetic toner used in the present invention has a saturation magnetization of 10–50 $Am^2/kg$ at a magnetic field of 79.6 kA/m (1000 oersted).

However, if the magnetic toner has a saturation magnetization of below 10 $Am^2/kg$ at a magnetic field of 79.6 kA/m, it becomes difficult to convey the magnetic toner on the toner-carrying member, and magnetic toner ear formation on the toner-carrying member becomes unstable, thus failing to provide uniform charge to the toner. As a result, image defects, such as fog, image density irregularity and recovery failure of transfer-residual toner are liable to be caused. If the magnetization exceeds 50 $Am^2/kg$, the toner particles are liable to have an increased magnetic agglomeratability, to result in remarkably lower flowability and transferability. As a result, the transfer-residual toner is increased. As a result, both the toner particles and electroconductive particles are liable to act, respectively, thus reducing an amount of electroconductive particles attached to the charging particle-carrying member. At the same time, an amount thereof located at the nip portion between the image-bearing member and the charging particle-carrying member is also decreased relative to that of the transfer residual toner, thus resulting in a lowering in chargeability leading to an occurrence of fog and image staining.

The magnetic values (saturation magnetization of the magnetic toner) described herein are based on values measured at 25° C. under an external magnetic field of 79.6 kA/m by using an oscillation-type magnetometer ("VSM P-1-10, made by Toei Kogyo K.K.). The magnetic toner used in the present invention may preferably be externally blended with the electroconductive particles (charging particles). The content of the electroconductive particles to the entire magnetic toner may preferably be 0.1–10 wt. %. Below 0.1 wt. %, it becomes difficult to supply an amount of the electrophotographics sufficient to overcome charging inhibition by the attachment or contamination of the insulating transfer residual toner onto the contact charging member to well effect charging of the image-bearing member to the nip portion or the charging section in proximity thereto between the charging member and the image-bearing member, thus lowering the chargeability to cause charging failure in some cases. Above 10 wt. %, the amount of the electroconductive particles recovered by the simultaneous developing and cleaning operation becomes too large, thus lowering the chargeability and developing performances of the magnetic toner at the developing section to cause a lowering in image density or toner scattering in some cases. In a preferred embodiment, the content of the electroconductive particles is 0.2–5 wt. %.

Hereinbelow, the present invention will be described more specifically based on Examples which however should not be construed to restrict the scope of the present invention.

EXAMPLE 1

Nine a-Si-based negatively chargeable photosensitive members having different silicon contents in surface layers were each prepared in the following manner.

An electroconductive substrate of mirror-finished Al cylinder having an outer diameter of 30 mm and a thickness of 2.5 mm was successively coated with a charge injection-barrier layer, a photoconductor layer, a buffer layer and a surface layer (a-C:H containing Si) by using a plasma CVD apparatus using RF power shown in FIG. 5 respectively under the following conditions to prepare Photosensitive members (A1), (A2), (A3), (A4), (A), (B), (C), (D) and (E).

Charge Injection-barrier Layer

| | |
|---|---|
| $SiH_4$ | 150 ml/min (under NTP = 298 K/$10^5$ Pa) |
| $PH_3$ | 500 ppm (based on $SiH_4$) |
| NO | 10 ml/min (NTP) |
| Power | 200 W (13.56 MHz) |
| Internal press. | 67 Pa |
| Substrate temp. | 240° C. |
| Thickness | 1 μm |

Photoconductor Layer

| | |
|---|---|
| $SiH_4$ | 200 ml/min (NTP) |
| Power | 500 W (13.56 MHz) |

-continued

| | |
|---|---|
| Internal press. | 67 Pa |
| Substrate temp. | 240° C. |
| Thickness | 25 μm |

Buffer Layer

| | |
|---|---|
| $SiH_4$ | 50 ml/min (NTP) |
| $CH_4$ | 500 ml/min (NTP) |
| Power | 1500 W (13.56 MHz) |
| Internal press. | 67 Pa |
| Substrate temp. | 240° C. |
| Thickness | 0.5 μm |

Surface Layer

| | | |
|---|---|---|
| $SiH_4$ | (A1) | 0.15 ml/min (NTP) |
| | (A2) | 0.2 ml/min (NTP) |
| | (A3) | 0.5 ml/min (NTP) |
| | (A4) | 0.7 ml/min (NTP) |
| | (A) | 1.0 ml/min (NTP) |
| | (B) | 1.5 ml/min (NTP) |
| | (C) | 4.0 ml/min (NTP) |
| | (D) | 6.0 ml/min (NTP) |
| | (E) | 8.0 ml/min (NTP) |
| $CH_4$ | | 100 ml/min (NTP) |
| Power | | 1500 W (13.56 MHz) |
| Internal press. | | 67 Pa |
| Substrate temp. | | 50° C. |
| Thickness | | 0.3 μm |

Polymerization toner (1) was prepared in the following manner.

Into 709 g of deionized water, 451 g of 0.1M-$Na_3PO_4$ aqueous solution was added, and after heating to 60° C., 67.7 g of 1.0 M-$CaCl_2$ aqueous solution was gradually added to form an aqueous medium containing calcium phosphate ($Ca_3(PO_4)_2$).

| | |
|---|---|
| Styrene | 80 wt. part(s) |
| n-Butyl acrylate | 20 wt. part(s) |
| Unsaturated polyester resin | 2 wt. part(s) |
| Saturated polyester resin | 3 wt. part(s) |
| Negative charge control agent (monoazo dye-Fe compound) | 1 wt. part(s) |
| Surface-treated hydrophobic magnetic powder | 90 wt. part(s) |

The above ingredients were uniformly dispersed and mixed by an attritor (made by Mitsui Miike Kakoki K.K.) to form a monomer composition.

To the monomer composition warmed at 60° C., 6 wt. parts of ester wax principally comprising behenyl behenate (Tabs.max (maximum heat-absorption peak temperature on a DSC curve)=72° C.) was added to be dissolved therein, and 5 wt. parts of 2,2'-azobis(2,4-dimethylvaleronitrile) (polymerization initiator showing $t_{1/2}$ (half-attenuation period)=140 min. at 60° C.) was added to be dissolved, thereby forming a polymerizable monomer mixture.

The thus-formed polymerizate monomer mixture was charged into the above-prepared aqueous medium and stirred at 60° C. in an $N_2$ atmosphere for 15 min. at 10,000 rpm by a TK homomixer (made by Tokushu Kika Kogyo K.K.) to form the droplets of the monomer mixture into particles. Then, the system was further stirred by a paddle stirrer and subjected to 6 hours of reaction at 60° C. Thereafter, the liquid temperature was raised to 80° C. for further 4 hours of reaction. After the reaction, the system was subjected to 2 hours of distillation at 80° C. After cooling, hydrochloric acid was added to the suspension liquid to dissolve the calcium phosphate salt. Then, the polymerizate was filtered out, washed with water and dried to recover black-colored magnetic toner particles having a weight-average particle size (D4) of 6.5 μm.

Then, 100 wt. parts of the magnetic toner particles were blended with 1.2 wt. parts of hydrophobic silica fine powder (primary particle size=8 nm, $S_{BET}$=250 $m^2/g$) which had been treated with hexamethyldisilazane, and 2 wt. parts of zinc oxide particles by means of a Henschel mixer (made by Mitsui Miike Kakoki K.K.) to obtain Polymerization toner (1).

The thus-obtained Polymerization toner (1) exhibited an average circularity (Cav) of 0.983 and a magnetization of 28 $Am^2/kg$ at a magnetic field of 79.6 kA/m.

In this example, as charging particles, zinc oxide particles were used. The zinc oxide particles were provided in the following manner.

Zinc oxide primary particles having a primary particle size of 0.1–0.3 μm were agglomerated under pressure, followed by pneumatic classifier to obtain zinc oxide particles, which exhibited a volume-average particle size (Dv) of 1.5 μm, a particle size distribution including 35% by volume of particles of 0.5 μm or smaller (V % (D≦0.5 μm)=35% by volume) and 0% by number of particles of 5 μm or larger (N % (D≧5 μm)=0% by number), a resistivity of $10^7$ ohm.cm, and a transmittance of 35%.

As a result of observation through a scanning electron microscope (SEM) at magnifications of $3\times10^3$ and $3\times10^4$, the zinc oxide particles were found to be principally composed of zinc oxide primary particles of 0.1–0.3 μm in primary particle size and agglomerated particles of 1–4 μm.

Each of the above-prepared photosensitive members (A1) to (A4) and (A) to (E) was subjected to evaluation in terms of the following items in combination with the above-prepared Polymerization toner (1) by using an electrophotographic apparatus shown in FIG. 3 including an elastic charging roller for charging the photosensitive member via the zinc oxide (charging) particles. At that time, a process (peripheral) speed of the photosensitive member was set to 400 mm/sec, and a relative speed ratio between the photosensitive member and the elastic charging roller was set to 200% (i.e., the photosensitive member and the charging roller were moved in mutually opposite directions at an identical peripheral moving speed).

Silicon Content (Si/(Si+C))

Surface layers were each formed on a silicon wafer under the same condition as in those for the photosensitive members (A1) to (A4) and (A) to (E) and subjected to measurement of relative values of silicon and carbon contents by using ESCA (X-ray photoelectron spectroscopy) to determine a silicon content as Si/(Si+C).

Chargeability of Charging Roller

A continuous image forming test on 100,000 sheets (A4 size) was performed by applying a certain voltage to the charging roller.

A dark-part potential at a position of the developing device was measured every 10,000 sheets to check on a change in dark-part potential. Further, a half-tone image was formed by adjusting a developing bias voltage so as to output a dark-part potential image at a half-tone image density, and a resultant image density distribution was observed with eyes.

Evaluation was performed according to the following standard.

A: No charge in dark-part potential was observed (i.e., the change was at an error tolerance level), and the half-tone image was uniform.

B: A lowering in dark-part potential was observed in a later stage of the continuous image forming test, and the half-tone image somewhat caused an irregularity in image density.

C: The dark-part potential was gradually lowered during the continuous image forming test, and an irregularity in image density was observed at the half-tone image portion.

Toner Discharge Efficiency from Charging Roller

An image density (as fogs) at a solid white portion after solid black image formation was measured every 10,000 sheets in the same manner as in the evaluation of charging roller chargeability described above. Specifically, an image density was measured with respect to toner particles peeled off from the photosensitive member surface by using an adhesive tape before and after charging to calculate a difference in image density between those before and after charging ((image density before charging)-(image density after charging)). A percentage of the image density difference to the image density before charging was determined as the toner discharge efficiency.

Evaluation was performed according to the following standard.

A: Toner discharge efficiency of at least 50%.

B: Toner discharge efficiency of at least 30% and below 50%.

C: Toner discharge efficiency of below 30%.

Charge Density of Toner Discharged from Charging Roller

A distribution of a charge density including triboelectric charge) as an average charge density was measured by using a charge density measuring apparatus ("E-SPART ANALYZER MODEL EST-11", mfd. by Hosokawa Micron K.K.).

Evaluation was performed according to the following standard.

A: An average charge density was shifted sufficiently to the negative side.

B: An average charge density was somewhat shifted to the negative side.

C: An average charge density was substantially zero.

Figure 6:
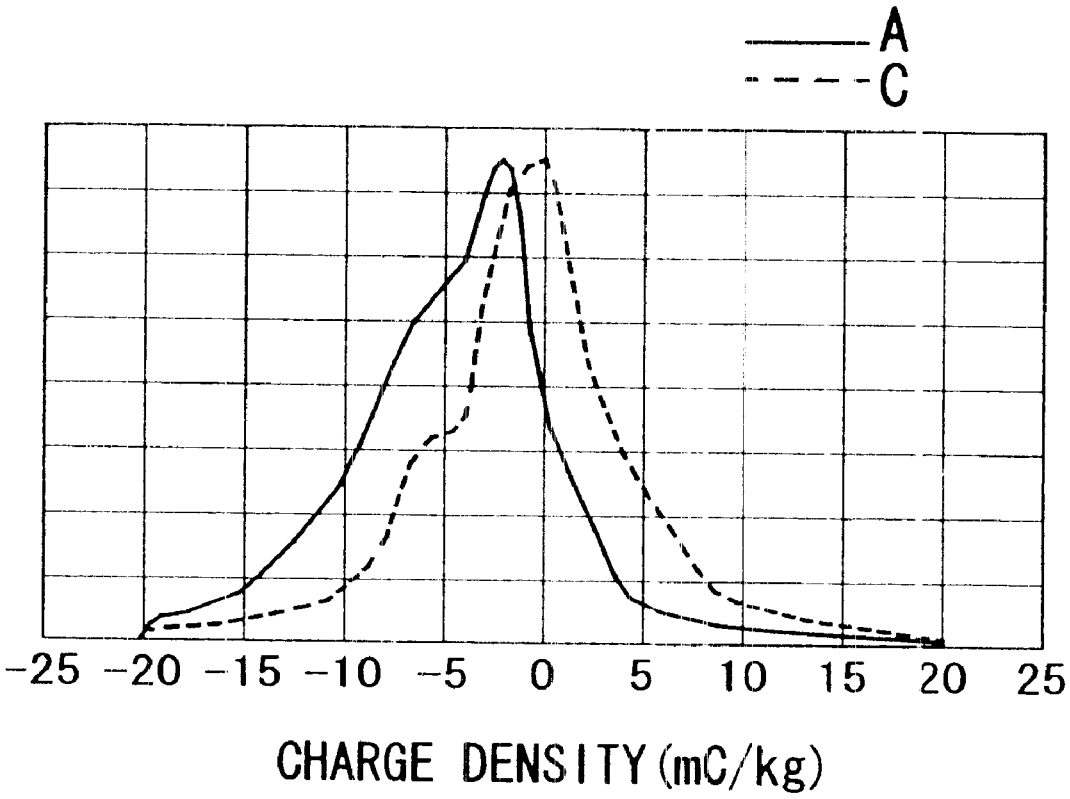
FIG. 6 is a graph showing some examples of measured toner charge distribution.

The results are also shown in FIG. 6. In FIG. 6, A curve of solid line represents the results of "A" and a curve of broken line represents the results of "C".

Fog

Simultaneously with the evaluations of the charging roller chargeability and toner discharge efficiency, measurement of a reflection density at a white background portion with respect to a sample image formed by using a test sheet ("NA-7 (A): FY9-9060A-010", made by Canon) was performed by using a Macbeth reflection densitometer ("RD 914", made by Macbeth Co.).

Evaluation was performed according to the following standard.

A: A change in reflection density was not observed (i.e., was within a measurement error), thus resulting in no fog on the white background.

B: An increase in reflection density was observed at a later stage of the continuous image forming test, and fog on a white background was somewhat observed.

C: A reflection density was gradually increased during the continuous image forming test, and fog on a white background was observed.

Abrasion of Surface Layer

A thickness of the surface layer before and after the continuous image forming test was measured to evaluate a degree of abrasion of the surface layer according to the following standard.

A: No abrasion was observed (i.e., a change in thickness was within a measurement error), thus resulting in a good abrasion resistance characteristic of the surface layer.

B: An abrasion was slightly observed but was at a practically acceptable level.

C: Abrasion was to a notable degree.

The evaluation results are shown in Table 1 appearing hereinafter.

Comparative Example 1

Photosensitive members (F), (G), (H) and (I) were prepared and evaluated in the same manner as in Example 1 except for employing $SiH_4$ gas flow rate for the surface layer shown below.

| Photosensitive member | $SiH_4$ flow rate (under NTP) |
|---|---|
| (F) | 0 ml/min |
| (G) | 0.1 ml/min |
| (H) | 9.0 ml/min |
| (I) | 15.0 ml/min |

The results are shown in Table 1 below.

TABLE 1

| Example No. | Photo-sensitive member | Polymeri-zation toner No | Si Content (atom. %) | Cav | Charge-ability | Discharge efficiency | Charge density | Fog | Abrasion | Overall evaluation |
|---|---|---|---|---|---|---|---|---|---|---|
| Ex. 1 | A1 | (1) | 0.28 | 0.983 | A | A | B | B | A | B |
| | A2 | (1) | 0.40 | 0.983 | A | A | B | B | A | B |
| | A3 | (1) | 1.12 | 0.983 | A | A | B | B | A | B |
| | A4 | (1) | 1.61 | 0.983 | A | A | B | B | A | B |
| | A | (1) | 3.0 | 0.983 | A | A | B | B | A | B |
| | B | (1) | 4.5 | 0.983 | A | A | A | A | A | A |
| | C | (1) | 11.0 | 0.983 | A | A | A | A | A | A |
| | D | (1) | 15.5 | 0.983 | A | A | A | A | B | B |
| | E | (1) | 20.0 | 0.983 | B | B | A | B | B | B |

TABLE 1-continued

| Example No. | Photo-sensitive member | Polymeri-zation toner No | Si Content (atom. %) | Cav | Charge-ability | Discharge efficiency | Charge density | Fog | Abrasion | Overall evaluation |
|---|---|---|---|---|---|---|---|---|---|---|
| Comp. | F | (1) | 0.0 | 0.983 | A | A | C | C | A | C |
| Ex. | G | (1) | 0.15 | 0.983 | A | A | C | C | A | C |
| 1 | H | (1) | 21.5 | 0.983 | B | B | A | B | C | C |
| | I | (1) | 29.0 | 0.983 | C | C | A | B | C | C |

As apparent from Table 1 (the results of Example 1 and Comparative Example 1), when the Si content (Si/(Si+C)) was at least 0.2 atom. %, triboelectric chargeability of the discharged toner (from the charging roller) was sufficiently made negatively chargeable one, thus effectively suppress an occurrence of fog. On the other hand, when the Si content was at most 20.0 atom. %, a higher toner discharge efficiency was retained, thus suppressing a lowering in chargeability of the charging roller due to contamination of toner particles while ensuring life extension of the charging roller.

It was also found that a lower Si content was advantageous to suppression of surface layer abrasion.

In Table 1, the item "overall evaluation" was based on that with respect to the respective items according to the following standard.

A: Very good

B: Good

C: At best a conventional level

EXAMPLE 2

A photosensitive member (B) (a-Si based) was prepared in the same manner as in Example 1.

Polymerization toners (A), (B), (C), (D) and (E) having different average circularities ($C_{AV}$) were prepared in the same manner as in the polymerization toner (1) of Example 1.

Evaluation was performed in the same manner as in Example 1 by using the above-prepared photosensitive member (B) and each of the polymerization toners (A) to (E).

The results are shown in Table 2 appearing hereinafter.

Comparative Example 2

A photosensitive member (B) and a polymerization toner (F) having a smaller $C_{AV}$ were prepared and evaluated in the same manner as in Example 1.

The results ar shown in Table 2.

As shown in Table 2, by providing a higher average circularity ($C_{AV}$) of at least 0.950 to the polymerization toner, it was found that a higher toner discharge efficiency was retained to prevent a lowering in charging roller chargeability caused by contamination of toner particles, thus prolonging the life of the charging roller. It was also found that the higher average circularity (of at least 0.950) was advantageous to negative triboelectric chargeability of the discharged toner (from the charging roller).

EXAMPLE 3

A photosensitive member (C) (a-Si based) was prepared in the same manner as in Example 1.

Pulverization toners (A) and (B) were each prepared in the following manner except for changing conditions of a mechanical sphering treatment from each other.

| | |
|---|---|
| Styrene/n-butyl acrylate copolymer (weight ratio = 80/20) | 100 wt. part(s) |
| Unsaturated polyester resin | 2 wt. part(s) |
| Saturated polyester resin | 3 wt. part(s) |
| Negative charge control agent (monoazo dye Fe compound) | 1 wt. part(s) |
| Surface-treated hydrophobic magnetic powder | 90 wt. part(s) |
| Ester wax (Tabs. max = 72° C.) | 5 wt. part(s) |

The above ingredients were blended in a blender and melt-kneaded by a twin-screw extruder heated at 115° C. After being cooled, the kneaded product was coarsely crushed by a hammer mill and finely pulverized by a jet mill, followed by a mechanical sphering treatment and pneumatic classification to obtain black-colored magnetic toner particles of D4=8.9 $\mu$m. Then, 100 wt. parts of the magnetic toner particles 13 were blended with 0.9 wt. parts of the hydrophobic silica fine powder ($S_{BET}$=180 $m^2/g$) which had

TABLE 2

| Example No. | Photo-sensitive member | Polymeri-zation toner No | Si Content (atom. %) | Cav | Charge-ability | Discharge efficiency | Charge density | Fog | Abrasion | Overall evaluation |
|---|---|---|---|---|---|---|---|---|---|---|
| Ex. 2 | B | (A) | 4.5 | 0.950 | B | A | B | B | A | B |
| | B | (B) | 4.5 | 0.960 | A | A | B | A | A | B |
| | B | (C) | 4.5 | 0.970 | A | A | A | A | A | A |
| | B | (D) | 4.5 | 0.985 | A | A | A | A | A | A |
| | B | (E) | 4.5 | 0.995 | A | A | A | A | A | A |
| Comp. Ex. 2 | B | (F) | 4.5 | 0.940 | C | C | B | C | A | C |

been successively treated with hexamethyldisilazane and silicone oil, and 2 wt. parts of zinc oxide particles (same as in Example 1) by a Henschel mixer (made by Mitsui Miike Kakoki K.K.) to obtain pulverization toners (A) and (B) having different average circularities ($C_{AV}$).

The thus-obtained pulverization toners (A) and (B) each exhibited a magnetization of 28 $Am^2/kg$ at a magnetic field of 79.6 kA/m.

By using the above-prepared photosensitive member (C) and each of the pulverization toners (A) and (B), evaluation was performed in the same manner as in Example 1.

The results are shown in Table 3.

Comparative Example 3

A photosensitive member (C) and a pulverization toner (C) having a smaller $C_{AV}$ were prepared and evaluated in the same manner as in Example 3 except that the mechanical sphering treatment was not performed in the toner production process.

The results are shown in Table 3.

TABLE 3

| Example No. | Photo-sensitive member | Pulveri-zation toner No | Si Content (atom. %) | Cav | Charge-ability | Discharge efficiency | Charge density | Fog | Abrasion | Overall evaluation |
|---|---|---|---|---|---|---|---|---|---|---|
| Ex. 3 | C | (A) | 11.0 | 0.950 | B | A | B | B | A | B |
| | C | (B) | 11.0 | 0.960 | A | A | B | A | A | B |
| Comp. Ex. 3 | C | (C) | 11.0 | 0.940 | C | C | C | C | A | C |

As apparent from the evaluation results of Example 3 and Comparative Example 3 (as shown in Table 3), the pulverization toners (A) and (B) having $C_{AV}$ of at least 0.950 exhibited better performances than the pulverization toner (C) having lower $C_{AV}$, similarly as in the case of the polymerization toners (Table 2).

EXAMPLE 4

Seven a-Si-based negatively chargeable photosensitive members having different silicon contents in surface layers were each prepared in the following manner.

An electroconductive substrate of mirror-finished Al cylinder having an outer diameter of 30 mm and a thickness of 2.5 mm was successively coated with a charge injection-barrier layer, a photoconductor layer, a buffer layer and a surface layer (a-C:H containing Si) by using a plasma CVD apparatus using VHF power shown in FIG. 4 respectively under the following conditions to prepare Photosensitive members (J1), (J2), (J3), (J4), (J), (K) and (L).

Charge Injection-Barrier Layer

| | |
|---|---|
| $SiH_4$ | 200 ml/min (under NTP = 298 K/$10^5$ Pa) |
| $H_2$ | 400 ml/min (NTP) |
| NO | 10 ml/min (NTP) |
| $PH_3$ | 2000 ppm (based on $SiH_4$) |
| Power | 1200 W (105 MHz) |
| Discharge space press. | 0.8 Pa |
| Substrate temp. | 250° C. |
| Thickness | 2 μm |

Photoconductor Layer

| | |
|---|---|
| $SiH_4$ | 200 ml/min (NTP) |
| $H_2$ | 400 ml/min (NTP) |
| Power | 1200 W (105 MHz) |
| Discharge space press. | 0.8 Pa |
| Substrate temp. | 250° C. |
| Thickness | 30 μm |

Buffer Layer

| | |
|---|---|
| $SiH_4$ | 20 ml/min (NTP) |
| $CH_4$ | 50 ml/min (NTP) |
| Power | 1200 W (105 MHz) |
| Discharge space press. | 0.8 Pa |
| Substrate temp. | 250° C. |
| Thickness | 0.3 μm |

Surface Layer

| | | |
|---|---|---|
| $SiH_4$ | (J1) | 0.07 ml/min (NTP) |
| | (J2) | 0.1 ml/min (NTP) |
| | (J3) | 0.25 ml/min (NTP) |
| | (J4) | 0.35 ml/min (NTP) |
| | (J) | 0.5 ml/min (NTP) |
| | (K) | 2.0 ml/min (NTP) |
| | (L) | 4.0 ml/min (NTP) |
| $CH_4$ | | 100 ml/min (NTP) |
| Power | | 1500 W (105 MHz) |
| Discharge space press. | | 0.5 Pa |
| Substrate temp. | | 100° C. |
| Thickness | | 0.5 μm |

Polymerization toner (2) was prepared in the following manner.

In the same manner as in Example 1, black-colored magnetic toner particles having a weight-average particle size (D4) of 6.4 μm was prepared.

Then, 100 wt. parts of the magnetic toner particles were blended with 1.2 wt. parts of hydrophobic silica fine powder (primary particle size 8 nm, $S_{BET}$=150 $m^2/g$) which had been successively treated with hexamethyldisilazane and silicone oil, and 2.0 wt. parts of zinc oxide particles (same as in Example 1) by means of a Henschel mixer (made by Mitsui Miike Kakoki K.K.) to obtain Polymerization toner (2).

The thus-obtained Polymerization toner (2) exhibited an average circularity (Cav) of 0.983 and a magnetization of 28 $Am^2/kg$ at a magnetic field of 79.6 kA/m.

By using each of the thus-prepared photosensitive members (J1) to (J4) and (J) to (L) and the polymerization toner (2), evaluation was performed in the same manner as in Example 1.

The results are shown in Table 4.

Comparative Example 4

Photosensitive members (M) and (N) (having lower and larger Si content) were prepared and evaluated in the same manner as in Example 4 except for employing $SiH_4$ gas flow rate for the surface layer shown below.

| | | |
|---|---|---|
| $SiH_4$ | (M) | 0.03 ml/min (NTP) |
| | (N) | 4.5 ml/min (NTP) |

By using each of the thus-prepared photosensitive members (M) and (N) and the polymerization toner (2), evaluation was performed in the same manner as in Example 1.

The results are shown in Table 4.

uniform, have a high contrast and a high resolution and are accompanied with little fog.

In the present invention, the image-bearing member further includes a buffer layer comprising a silicon-based non-single crystal material containing at least one of hydrogen and halogen and also at least one of carbon, oxygen and nitrogen between the photoconductor layer and the surface layer, whereby adhesive properties between the surface layer and the photoconductive layer can be improved and an influence of interference caused due to light reflection of a boundary therebetween can be further effectively alleviated.

Further, in the present invention, the surface layer is formed by a plasma chemical vapor deposition using a high frequency of 50–450 MHz wherein at least a hydrocarbon gas is decomposed by plasma to cause film deposition, thus allowing formation of the surface layer at a lower pressure condition and more effectively suppressing deterioration in characteristics of the surface layer, such as surface protection and light-transmissive performances.

TABLE 4

| Example No. | Photo-sensitive member | Polymeri-zation toner No | Si Content (atom. %) | Cav | Charge-ability | Discharge efficiency | Charge density | Fog | Abrasion | Overall evaluation |
|---|---|---|---|---|---|---|---|---|---|---|
| Ex. 4 | J1 | (2) | 0.28 | 0.983 | A | A | B | B | A | B |
| | J2 | (2) | 0.40 | 0.983 | A | A | B | B | A | B |
| | J3 | (2) | 1.12 | 0.983 | A | A | B | B | A | B |
| | J4 | (2) | 1.61 | 0.983 | A | A | B | B | A | B |
| | J | (2) | 3.0 | 0.983 | A | A | B | B | A | B |
| | K | (2) | 11.0 | 0.983 | A | A | A | A | A | A |
| | L | (2) | 20.0 | 0.983 | B | B | A | B | B | B |
| Comp. | M | (2) | 0.15 | 0.983 | A | A | C | C | A | C |
| Ex. 4 | N | (2) | 21.5 | 0.983 | B | B | A | B | C | C |

Similarly as in the case of using the plasma CVD using the RF power (Table 1), as shown in Table 4, it was found that the photosensitive members having the Si content of 0.2–20 atom. % prepared by using the plasma CVD using the VHF power also exhibited better performances than those having the lower and higher Si contents (0.15 atom % and 21.5 atom %).

Further, by using the polymerization toner in combination with the photosensitive member (having the Si content of 0.2–20 atom %), it was found that high-quality images were obtained.

As described hereinabove, according to the present invention, by using the above-mentioned specific image-bearing member (a-Si-based photosensitive member) and magnetic toner in combination, it becomes possible to realize a good toner recycle process even when a cleaning step is not performed between a transfer step and a charging step in an electrophotographic image forming method (apparatus) employing the IAE scheme.

Further, it is possible to provide an electrophotographic image forming system (method or apparatus) capable of remarkably reducing the amount of waste materials over an entire life of the system and stably providing clear images free from image flow or image irregularity for a long period in various environments.

Further it is possible to provide an electrophotographic image forming system having a long life of charging member and capable of stably providing high-quality images with a minimum maintenance cost.

Further, it becomes possible to provide an electrophotographic image forming system wherein a non-single crystal material (a-Si) photosensitive member is uniformly charged with no irregularity to provide clear images which are Further, in the present invention, the image-bearing member is charged by bringing the charging particle-carrying member carrying the charging particles into contact with the image-bearing member via the charging particles in such a state that the surface of the charging particle-carrying member is moved while providing a relative speed difference with the surface of the image-bearing member, thus ensuring an intimate contact state between the image-bearing member and the charging particles. In this case, the surface of the charging particle-carrying member and the surface of the image-bearing member are moved in mutually opposite directions, thus more effectively charging the image-bearing member.

In the present invention, the charging particle-carrying member comprises an elastic member having a porous surface, thus allowing a state such that a sufficient amount of the charging particles are carried on the image-bearing member and the contact therebetween is further enhanced.

Further, in the present invention, the charging particle-carrying member comprises a roller member having an Asker C hardness of at most 50 deg., thus providing a shape stability of the charging particle-carrying member and a followability with respect to minute unevenness at the surface of the charging particle-carrying member to further improve a contact with the image-bearing member.

Further, when the charging particle-carrying member comprises a roller member having a volume-resistivity of $1\times10^3$–$1\times10^8$ ohm.cm it is possible to provide good charging and leak resistance performances of the image-bearing member.

Further, when the electroconductive particles have a volume-resistivity of at most $1\times10^9$ ohm.cm, preferably of $1\times10^1$–$1\times10^9$ ohm.cm, it becomes possible to further enhance charge-imparting ability to the image-bearing member.

Further, when the toner has the electroconductive particles at its surface, excessive charge of the toner an effectively be prevented to suppress a lowering in developing performances.

Further, when the inorganic film powder has been subjected to hydrophobicity-imparting treatment, preferably with a silicone oil, it is possible to effectively suppress a charge in characteristics of the inorganic fine powder with a fluctuation in environmental conditions with respect to toner chargeability, developing characteristic, transferability, formed image qualities, etc.

Further, when the electroconductive particles are attached onto the surface of the image-bearing member in the developing step and remain thereon even after the transfer step to be conveyed to reach the charging particle-carrying member, it becomes possible to use the developing means as supply means for supplying charging particles to the charging particle-carrying member, thus allowing a small-sized apparatus and further improvement in maintenance performance.

What is claimed is:

1. An electrophotographic image forming method, comprising cyclic steps including:

a charging step of charging a rotating image-bearing member to charge a surface thereof;

a latent image forming steps of forming an electrostatic latent image on the charged surface of the image-bearing member;

a developing step of developing the electrostatic latent image with a negatively chargeable magnetic toner to form a toner image thereon; and a transfer step of transferring the toner image onto a recording material, wherein the image-bearing member comprises an electroconductive support, and a photoconductor layer and a surface layer formed on the support, said photoconductor layer comprising a silicon-based non-single crystal material containing at least one of hydrogen and halogen, said surface layer comprising a carbon-based non-single crystal material containing at least one of hydrogen and halogen and also containing silicon in a proportion of 0.2 to 20 atm. % as calculated by Si/(Si+C), said magnetic toner comprises toner particles comprising at least a binder resin and a magnetic material, and inorganic fine powder, has an average circularity of at least 0.950 and has a saturation magnetization of 10 to 50 $Am^2/kg$ as measured at 79.6 kA/m, in the charging step, the image-bearing member is charged to a negative polarity by a contact charging means including charging particles comprising principally electroconductive particles having particle sizes of 0.1–10 $\mu$m, and a charging particle carrying member having an electroconductive and elastic surface and carrying the charging particles on the surface so as to contact the image-bearing member via the charging particles, in the latent image forming step, an image forming part of the surface of the image-bearing member is exposed to light to provide an attenuated potential thereat, thereby forming the electrostatic latent image, and no cleaning step is included between the transfer step and the charging step.

2. The method according to claim 1, wherein the image-bearing member further includes a buffer layer comprising a silicon-based non-single crystal material containing at least one of hydrogen and halogen and also at least one of carbon, oxygen and nitrogen between the photoconductive layer and the surface layer.

3. The method according to claim 1, wherein the surface layer is formed by a plasma chemical vapor deposition using a high frequency of 50–450 MHz wherein at least a hydrocarbon gas is decomposed by plasma to cause film deposition.

4. The method according to claim 1, wherein in the charging step, the image-bearing member is charged by bringing the charging particle-carrying member carrying the charging particles into contact with the image-bearing member via the charging particles in such a state that the surface of the charging particle-carrying member is moved while providing a relative speed difference with the surface of the image-bearing member.

5. The method according to claim 4, wherein the surface of the charging particle-carrying member and the surface of the image-bearing member are moved in mutually opposite directions to charge the image-bearing member in the charging step.

6. The method according to claim 1, wherein the charging particle-carrying member comprises an elastic member having a porous surface.

7. The method according to claim 1, wherein the charging particle-carrying member comprises a roller member having an Asker C hardness of at most 50 deg.

8. The method according to claim 1, wherein the charging particle-carrying member comprises a roller member having an Asker C hardness of 25–50 deg.

9. The method according to claim 1, wherein the charging particle-carrying member comprises a roller member having a volume-resistivity of $1\times10^3$–$1\times10^8$ ohm.cm.

10. The method according to claim 1, wherein the electroconductive particles have a volume-resistivity of at most $1\times10^9$ ohm.cm.

11. The method according to claim 1, wherein the electroconductive particles have a volume-resistivity of $1\times10^1$–$1\times10^9$ ohm.cm.

12. The method according to claim 1, wherein the toner has the electroconductive particles at its surface.

13. The method according to claim 1, wherein the inorganic fine powder has been subjected to hydrophobicity-imparting treatment.

14. The method according to claim 13, wherein the inorganic fine powder has been treated with a silicone oil.

15. The method according to claim 1, wherein the electroconductive particles are attached onto the surface of the image-bearing member in the developing step and remain thereon even after the transfer step to be conveyed to reach the charging particle-carrying member.

16. An electrophotographic image forming apparatus, comprising:

a rotating image-bearing member;

a charging means for charging the rotating image-bearing member to charge a surface thereof;

a latent image forming means for forming an electrostatic latent image on the charged surface of the image-bearing member;

a developing means for developing the electrostatic latent image with a negatively chargeable magnetic toner to form a toner image thereon; and a transfer means for transferring the toner image onto a recording material, wherein the image-bearing member comprises an electroconductive support, and a photoconductor layer and a surface layer formed on the support; said photoconductor layer comprising a silicon-based non-single crystal material containing at least one of hydrogen and halogen, said surface layer comprising a carbon-based non-single crystal material containing at least one of hydrogen and halogen and also containing silicon in a proportion of 0.2 to 20 atm. % as calculated by Si/(Si+C), said magnetic toner comprises toner particles comprising at least a binder resin and a magnetic material, and inorganic fine powder, has an average circularity of at least 0.950 and has a saturation magnetization of 10 to 50 $Am^2/kg$ as measured at 79.6 kA/m, the charging means includes charging particles comprising principally electroconductive particles having particle sizes of 0.1–10 $\mu$m, and a charging particle-carrying member carrying the charging particles so as to contact the image-bearing member via the charging particles, thereby charging the image-bearing member to a negative polarity, the latent image-forming means includes an exposure means for exposing an image forming part of the image-bearing member to provide an attenuated potential thereat, and no cleaning means is present between the transfer means and the charging means along the surface of the image-bearing member.

17. The apparatus according to claim 16, wherein the image-bearing member further includes a buffer layer comprising a silicon-based non-single crystal material containing at least one of hydrogen and halogen and also at least one of carbon, oxygen and nitrogen between the photoconductive layer and the surface layer.

18. The apparatus according to claim 16, wherein the surface layer is formed by a plasma chemical vapor deposition using a high frequency of 50–450 MHz wherein at least a hydrocarbon gas is decomposed by plasma to cause film deposition.

19. The apparatus according to claim 16, wherein the image-bearing member is charged by bringing the charging particle-carrying member carrying the charging particles into contact with the image-bearing member via the charging particles in such a state that the surface of the charging particle-carrying member is moved while providing a relative speed difference with the surface of the image-bearing member.

20. The apparatus according to claim 19, wherein the surface of the charging particle-carrying member and the surface of the image-bearing member are moved in mutually opposite directions to charge the image-bearing member.

21. The apparatus according to claim 16, wherein the charging particle-carrying member comprises an elastic member having a porous surface.

22. The apparatus according to claim 16, wherein the charging particle-carrying member comprises a roller member having an Asker C hardness of at most 50 deg.

23. The apparatus according to claim 16, wherein the charging particle-carrying member comprises a roller member having an Asker C hardness of 25–50 deg.

24. The apparatus according to claim 16, wherein the charging particle-carrying member comprises a roller member having a volume-resistivity of $1\times10^3$–$1\times10^8$ ohm.cm.

25. The apparatus according to claim 16, wherein the electroconductive particles have a volume-resistivity of at most $1\times10^9$ ohm.cm.

26. The apparatus according to claim 16, wherein the electroconductive particles have a volume-resistivity of $1\times10^1$–$1\times10^9$ ohm.cm.

27. The apparatus according to claim 16, wherein the toner has the electroconductive particles at its surface.

28. The apparatus according to claim 16, wherein the inorganic fine powder has been subjected to hydrophobicity-imparting treatment.

29. The apparatus according to claim 28, wherein the inorganic fine powder has been treated with a silicone oil.

30. The apparatus according to claim 16, wherein the electroconductive particles are attached onto the surface of the image-bearing member in the developing step and remain thereon even after the transfer step to be conveyed to reach the charging particle-carrying member.

* * * * *

UNITED STATES PATENT AND TRADEMARK OFFICE

CERTIFICATE OF CORRECTION

PATENT NO. : 6,670,089 B2
DATED : December 30, 2003
INVENTOR(S) : Ehara et al.

It is certified that error appears in the above-identified patent and that said Letters Patent is hereby corrected as shown below:

Title page,
Item [57], ABSTRACT,
Line 4, “steps” should read -- step --.

Column 9,
Line 7, “be” should be deleted.
Line 9, “such” should read -- such as --.
Line 20, “comprises” should read -- comprising --.
Line 48, “sturctural” should read -- structural defects --.

Column 16,
Line 20, “wile” should read -- while --.

Column 19,
Line 61, “an” should read -- and --.

Column 20,
Lines 25 and 29, “powder” should read -- powders --.

Column 21,
Line 40, “components” should read -- components, --.

Column 22,
Line 15, “polymerization is” should read -- polymerization, are --.

Column 25,
Line 1, “a” should be deleted.

Column 31,
Line 3, “charge” should read -- change --.

Column 33,
Line 51, “ar” should read -- are --.

UNITED STATES PATENT AND TRADEMARK OFFICE

CERTIFICATE OF CORRECTION

PATENT NO. : 6,670,089 B2
DATED : December 30, 2003
INVENTOR(S) : Ehara et al.

It is certified that error appears in the above-identified patent and that said Letters Patent is hereby corrected as shown below:

Column 39,
Line 2, “an” should read -- can --.
Line 25, “steps” should read -- step --.

Signed and Sealed this

Fifteenth Day of June, 2004

JON W. DUDAS
*Acting Director of the United States Patent and Trademark Office*